US008934806B2

(12) United States Patent
Koyama

(10) Patent No.: US 8,934,806 B2
(45) Date of Patent: Jan. 13, 2015

(54) AIR SENDING MECHANISM AND IMAGE FORMING APPARATUS

(71) Applicant: Fuji Xerox Co., Ltd, Tokyo (JP)

(72) Inventor: Takaharu Koyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 88 days.

(21) Appl. No.: 13/625,236

(22) Filed: Sep. 24, 2012

(65) Prior Publication Data

US 2013/0259511 A1 Oct. 3, 2013

(30) Foreign Application Priority Data

Mar. 27, 2012 (JP) ..... 2012-071632

(51) Int. Cl.
*G03G 21/20* (2006.01)

(52) U.S. Cl.
USPC ..... 399/92

(58) Field of Classification Search
CPC ..... G03G 15/2021; G03G 15/2017; G03G 15/2053; G03G 21/0052; G03G 21/206; G03G 2221/1645
See application file for complete search history.

(56) References Cited

U.S. PATENT DOCUMENTS

| | | | | |
|---|---|---|---|---|
| 5,185,629 | A * | 2/1993 | Iino et al. | 399/93 |
| 7,587,154 | B2 * | 9/2009 | Sakai et al. | 399/92 |
| 2006/0072933 | A1 * | 4/2006 | Miyamoto et al. | 399/92 |
| 2012/0229837 | A1 * | 9/2012 | Kubo | 358/1.13 |

FOREIGN PATENT DOCUMENTS

| | | | |
|---|---|---|---|
| JP | 08-095474 | A | 4/1996 |
| JP | 2008-119887 | A | 5/2008 |
| JP | 2011-64748 | A | 3/2011 |
| JP | 2011-107511 | A | 6/2011 |

* cited by examiner

*Primary Examiner* — Clayton E Laballe
*Assistant Examiner* — Victor Verbitsky
(74) *Attorney, Agent, or Firm* — Sughrue Mion, PLLC

(57) ABSTRACT

An air sending mechanism includes an air sending unit including a rotating shaft and a plurality of blade members provided on the rotating shaft, the air sending unit being configured to send air by producing a swirl flow swirling about the rotating shaft with rotation of the plurality of blade members; a wall member provided on a downstream side in an air sending direction with respect to the air sending unit in such a manner as to face the air sending unit; and a rectifying member provided between the air sending unit and the wall member and having at least one bend or curve provided as a result of the member being angled or curved such that the swirl flow produced by the air sending unit is guided in an intersecting direction that intersects the air sending direction.

2 Claims, 19 Drawing Sheets

AIR SENDING MECHANISM AND IMAGE FORMING APPARATUS

CROSS-REFERENCE TO RELATED APPLICATIONS

This application is based on and claims priority under 35 USC 119 from Japanese Patent Application No. 2012-071632 filed Mar. 27, 2012.

BACKGROUND

Technical Field

The present invention relates to an air sending mechanism and an image forming apparatus.

SUMMARY

According to an aspect of the invention, there is provided an air sending mechanism including an air sending unit including a rotating shaft and a plurality of blade members provided on the rotating shaft, the air sending unit being configured to send air by producing a swirl flow swirling about the rotating shaft with rotation of the plurality of blade members; a wall member provided on a downstream side in an air sending direction with respect to the air sending unit in such a manner as to face the air sending unit; and a rectifying member provided between the air sending unit and the wall member and having at least one bend or curve provided as a result of the member being angled or curved such that the swirl flow produced by the air sending unit is guided in an intersecting direction that intersects the air sending direction.

BRIEF DESCRIPTION OF THE DRAWINGS

An exemplary embodiment of the present invention will be described in detail based on the following figures, wherein.

DETAILED DESCRIPTION

An air sending mechanism and an image forming apparatus according to an exemplary embodiment of the present invention will now be described.

Overall Configuration

Figure 1:
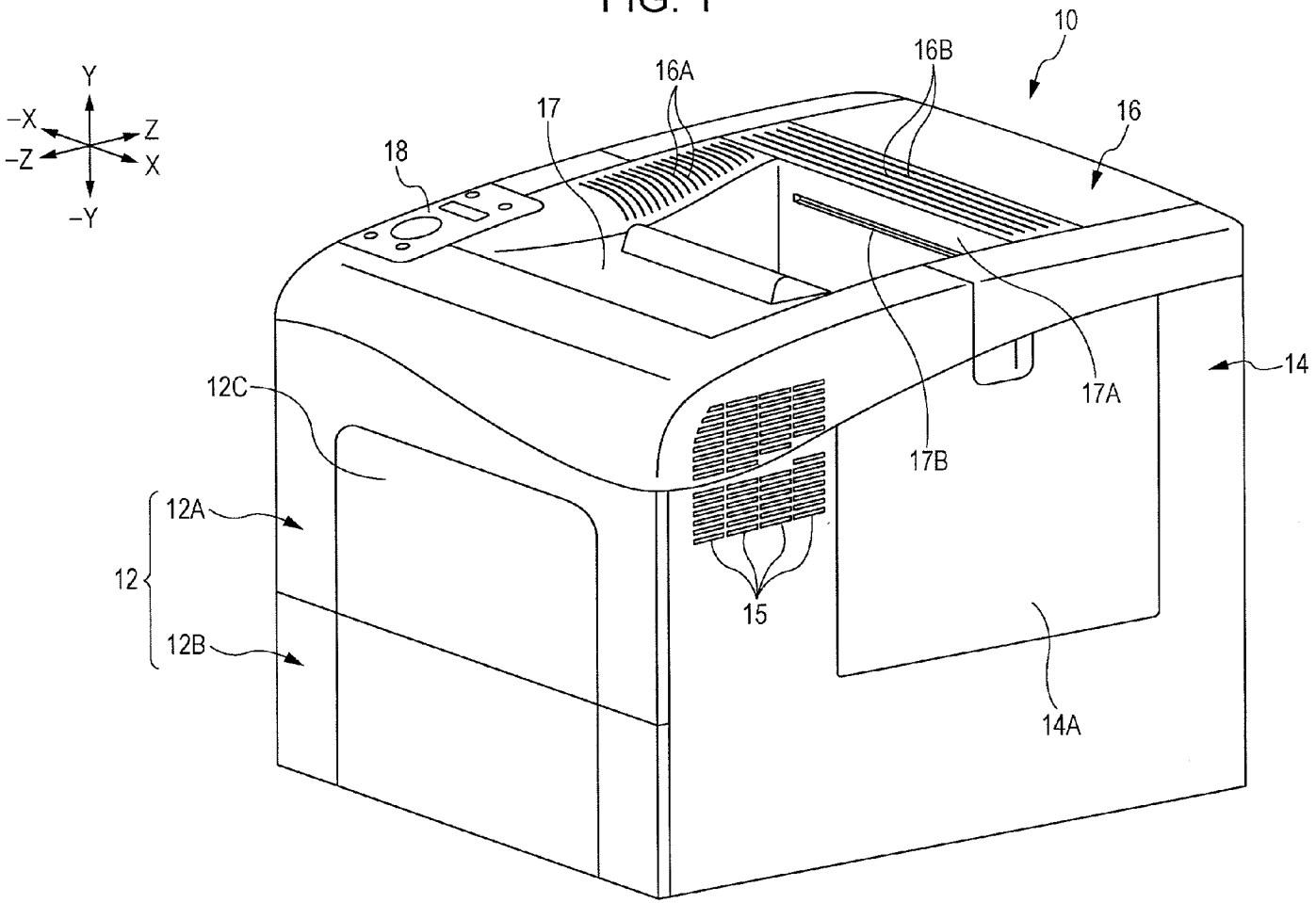
FIG. 1 is an external view of an image forming apparatus according to an exemplary embodiment of the present invention.

FIG. 1 illustrates an image forming apparatus 10 according to an exemplary embodiment of the present invention. The X direction, the −X direction, the Y direction, the −Y direction, the Z direction, and the −Z direction are represented by arrows illustrated in the drawings. The circled X and the circled dot illustrated in the drawings represent an arrow oriented from the near side toward the far side and an arrow oriented from the far side toward the near side, respectively.

When the image forming apparatus 10 is seen straight from a side where the user (not illustrated) stands, the X direction corresponds to the rightward direction, the −X direction corresponds to the leftward direction, the Y direction corresponds to the upward direction, the −Y direction corresponds to the downward direction, the Z direction corresponds to the rearward direction, and the −Z direction corresponds to the frontward direction. In the following description, when there is no need to distinguish between the X direction and the −X direction, between the Y direction and the −Y direction, and between the Z direction and the −Z direction, the pairs of directions are simply referred to as the X direction, the Y direction, and the Z direction, respectively.

The image forming apparatus 10 generally has a box shape and includes a front covering 12 provided on the −Z-direction side thereof, a rear covering (not illustrated) provided on the Z-direction side thereof, a left covering (not illustrated) provided on the −X-direction side thereof, a right covering 14 provided on the X-direction side thereof, a top covering 16 provided on the Y-direction side thereof, and a bottom covering (not illustrated) provided on the −Y-direction side thereof.

The front covering 12 includes upper and lower parts: specifically, an upper covering portion 12A and a lower covering portion 12B. The upper covering portion 12A includes a central part, a lower central part, and a peripheral part. The central part and the lower central part of the upper covering portion 12A integrally form a first opening/closing covering 12C that is provided with a hinge member (not illustrated) and is openable in the −Z direction. The first opening/closing covering 12C is openable by tilting an upper part thereof toward the −Z-direction side.

The first opening/closing covering 12C also forms a −Z-direction-side part of a manual feeding portion (not illustrated) from which recording paper P (see FIG. 2) as an exemplary recording medium is manually fed by the user. The lower covering portion 12B forms a −Z-direction-side part of a paper container 22 to be described below.

The right covering 14 includes a central part and a peripheral part. The central part forms a second opening/closing covering 14A that is provided with a hinge member (not illustrated) and is openable in the X direction. The second opening/closing covering 14A is openable by tilting an upper part thereof toward the X-direction side. The right covering 14 has an air inlet 15 provided at a position of the peripheral part thereof on the −Z-direction side and on the Y-direction side (at the upper front). The air inlet 15 includes plural slits extending through the right covering 14 in the X direction.

A central part of the top covering 16 is recessed in the −Y direction. The recessed part of the top covering 16 forms an output portion 17 onto which the recording paper P is output. The output portion 17 includes an upright wall 17A provided on the Z-direction side thereof and standing upright in the Y direction. The upright wall 17A has an output slit 17B from which the recording paper P is output in the −Z direction. The top covering 16 is provided with an operation panel 18, which is operated by the user, at a position thereof on the −Z-direction side and on the −X-direction side (at the front left).

The top covering 16 has a left air outlet 16A at a position thereof on the −X-direction side with respect to the output portion 17 and a rear air outlet 16B at a position thereof on the Z-direction side with respect to the output portion 17. The left air outlet 16A and the rear air outlet 16B each include plural slits extending through the top covering 16 in the Y direction.

Figure 2:
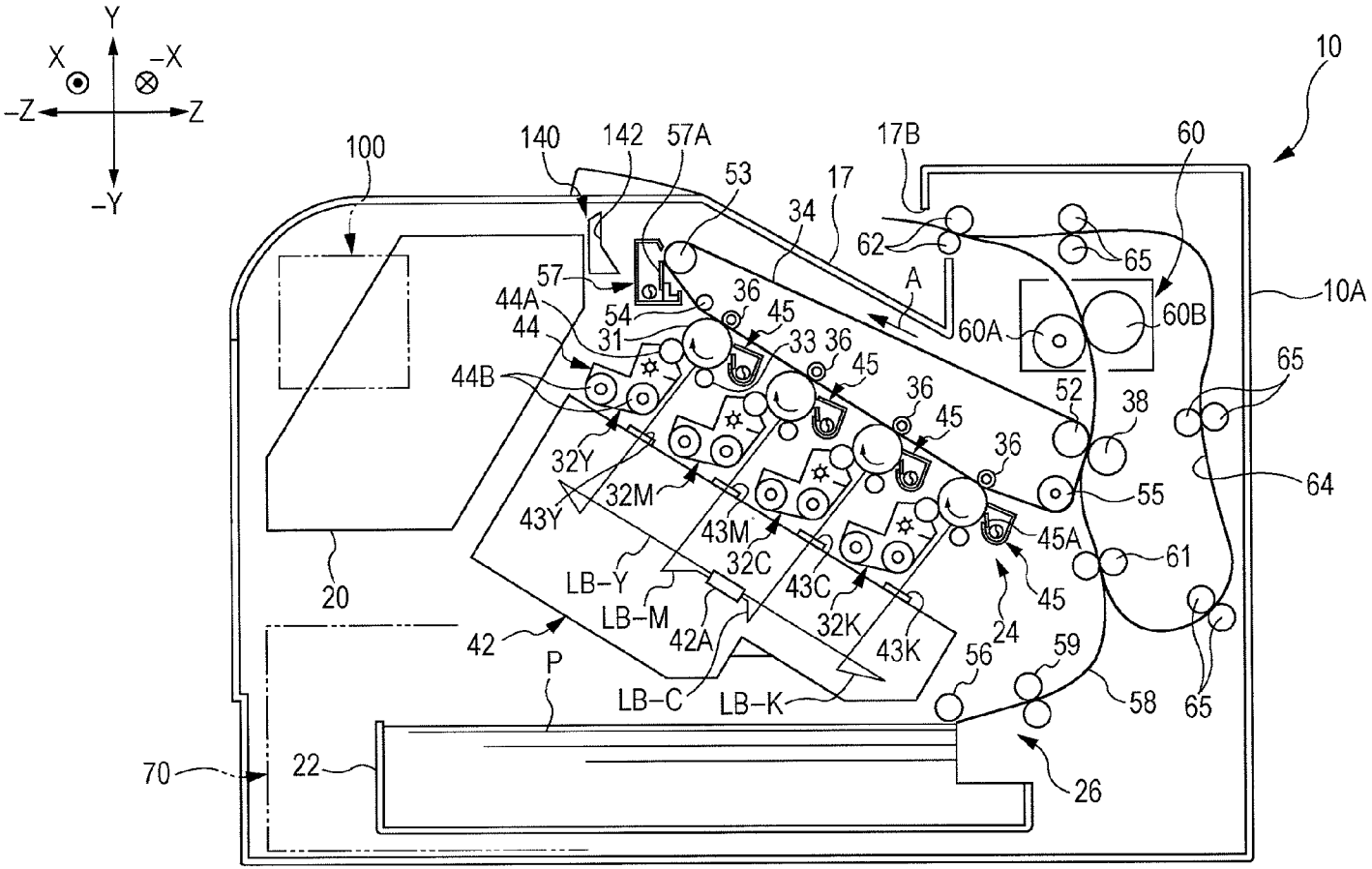
FIG. 2 illustrates an overall configuration of the image forming apparatus according to the exemplary embodiment of the present invention.

Referring to FIG. 2, the image forming apparatus 10 includes an apparatus body 10A. The coverings (see FIG. 1) are provided on the outer side of the apparatus body 10A. Other components are provided in the apparatus body 10A. The image forming apparatus 10 further includes the paper container 22 that contains the recording paper P, an image forming section 24 that forms an image on the recording paper P, a transport section 26 that transports the recording paper P from the paper container 22 to the image forming section 24, a fixing device 60 that is an exemplary fixing section and fixes the image formed by the image forming section 24 on the recording paper P, a controller 20 that controls operations performed by the components of the image forming apparatus 10, a power source section 70 that supplies power to the image forming section 24 and to the fixing device 60, and an air sending mechanism 100 that sends air toward the image forming section 24, toward the fixing device 60, and toward the power source section 70.

The image forming section 24 includes image forming units 32Y, 32M, 32C, and 32K that form developer images (hereinafter referred to as toner images) in different colors of yellow (Y), magenta (M), cyan (C), and black (K), respectively; an intermediate transfer belt 34 to which the toner images formed by the image forming units 32Y, 32M, 32C, and 32K are transferred; first-transfer rollers 36 that transfer the toner images, respectively, formed by the image forming units 32Y, 32M, 32C, and 32K to the intermediate transfer belt 34; and a second-transfer roller 38 that transfers the toner images transferred to the intermediate transfer belt 34 by the first-transfer rollers 36 from the intermediate transfer belt 34 to the recording paper P. The image forming section 24 is not necessarily configured as described above and may be configured in any other way, as long as the image forming section 24 forms an image on the recording paper P.

The image forming units 32Y, 32M, 32C, and 32K are arranged in the apparatus body 10A along a virtual line angled with respect to the Z direction. The image forming units 32Y, 32M, 32C, and 32K each include a photoconductor 31 that rotates in one direction (for example, the clockwise direction in FIG. 2). The image forming units 32Y, 32M, 32C, and 32K all have the same configuration. Therefore, in FIG. 2, suffixes Y, M, C, and K for reference numerals denoting members included in the image forming units 32Y, 32M, 32C, and 32K are omitted. In the following description, when there is no need to distinguish among the members by using the suffixes Y, M, C, and K, the suffixes Y, M, C, and K are omitted.

The photoconductor 31 includes an electrically conductive supporting member and a photosensitive layer provided over the surface of the supporting member. The photoconductor 31 is configured to rotate at a preset speed. The photoconductor 31 is surrounded by, in order from the upstream side in the direction of rotation thereof, a charging roller 33 that charges the photoconductor 31, an exposure device 42 that performs exposure on the outer circumferential surface of the photoconductor 31 charged by the charging roller 33, a developing device 44 that develops an electrostatic latent image formed on the photoconductor 31 through the exposure performed by the exposure device 42 and thus forms a toner image, and a cleaning unit 45 that cleans the outer circumferential surface of the photoconductor 31 that has undergone the first transfer of the toner image.

The charging roller 33 includes, for example, an electrically conductive shaft and an electrically conductive elastic layer provided around the shaft. When a voltage that allows the shaft to discharge electricity is applied to the shaft from a voltage applying unit (not illustrated), an electrical discharge occurs because of the potential difference from the photoconductor 31, which is grounded, whereby the outer circumferential surface of the photoconductor 31 is, for example, negatively charged.

The exposure device 42 is provided obliquely below the image forming units 32Y, 32M, 32C, and 32K and performs exposure on the outer circumferential surfaces of the photoconductors 31 charged by the charging rollers 33, whereby electrostatic latent images are formed on the respective photoconductors 31. More specifically, the exposure device 42 includes four semiconductor lasers (not illustrated) all having the same configuration and provided for the four respective image forming units 32Y, 32M, 32C, and 32K. The semiconductor lasers emit laser beams LB-Y, LB-M, LB-C, and LB-K, respectively, in accordance with tone data.

The laser beams LB-Y, LB-M, LB-C, and LB-K emitted from the semiconductor lasers are applied to a rotatable polygonal mirror 42A via a cylindrical lens (not illustrated) and are scanningly deflected by the polygonal mirror 42A. The laser beams LB-Y, LB-M, LB-C, and LB-K scanningly deflected by the polygonal mirror 42A travel through imaging lenses (not illustrated), are reflected by mirrors (not illustrated), travel through glass windows 43Y, 43M, 43C, and 43K, and are scanningly applied from obliquely below to exposure points defined on the respective photoconductors 31. The electrostatic latent images on the photoconductors 31 are formed on the basis of image signals sent from the controller 20. The image signals sent from the controller 20 are acquired from, for example, an external apparatus by the controller 20.

The developing device 44 includes a developing roller 44A that supplies developer (for example, toner) to the photoconductor 31, and plural transport members 44B that circulate and transport the developer to be supplied to the developing roller 44A while stirring the developer.

The cleaning unit 45 includes a cleaning blade 45A. The tip of the cleaning blade 45A is in contact with the outer circumferential surface of the photoconductor 31. Therefore, the cleaning blade 45A scrapes toner residues, paper lint, and the like from the outer circumferential surface of the photoconductor 31.

The intermediate transfer belt 34 is endless (has a ring shape) and is rotatably provided above (on the Y-direction side with respect to) the image forming units 32Y, 32M, 32C, and 32K. The intermediate transfer belt 34 is stretched around stretching rollers 52, 53, 54, and 55 provided on the inner side thereof. The stretching rollers 52, 53, 54, and 55 are rotatable about their respective axes extending in the X direction. When any of the stretching rollers 52, 53, 54, and 55 is driven to rotate, the intermediate transfer belt 34 rotates in one direction (for example, in the counterclockwise direction in FIG. 2 (in a direction indicated by arrow A)) while being in contact with the photoconductors 31. The stretching roller 52 functions as a counter roller provided opposite the second-transfer roller 38.

A cleaning unit 57 that removes toner residues, paper lint, and the like adhered to the outer circumferential surface of the intermediate transfer belt 34 that has undergone second transfer is provided across the intermediate transfer belt 34 from the stretching roller 53. The cleaning unit 57 includes a cleaning blade 57A. The tip of the cleaning blade 57A is in contact with the outer circumferential surface of the intermediate transfer belt 34. Therefore, the cleaning blade 57A scrapes toner residues, paper lint, and the like from the outer circumferential surface of the intermediate transfer belt 34.

The first-transfer rollers 36 are provided across the intermediate transfer belt 34 from the respective photoconductors 31. The toner images formed on the photoconductors 31 are transferred to the intermediate transfer belt 34 at respective first-transfer positions defined between the first-transfer rollers 36 and the photoconductors 31. A voltage is applied to each of the first-transfer rollers 36 from a voltage applying unit (not illustrated). The toner images on the photoconductors 31 are first-transferred to the intermediate transfer belt 34 by utilizing the potential difference between the photoconductors 31, which are grounded, and the first-transfer rollers 36, to which the voltage is applied.

The second-transfer roller 38 is provided across the intermediate transfer belt 34 from the stretching roller 52. The toner images transferred to the intermediate transfer belt 34 are transferred to the recording paper P at a second-transfer position defined between the second-transfer roller 38 and the stretching roller 52. A voltage is applied to the second-transfer roller 38 from a voltage applying unit (not illustrated). The toner images on the intermediate transfer belt 34 are second-transferred to the recording paper P by utilizing the potential difference between the stretching roller 52, which is grounded, and the second-transfer roller 38, to which the voltage is applied.

The transport section 26 includes a feed roller 56 that feeds the recording paper P from the paper container 22, a transport path 58 along which the recording paper P fed by the feed roller 56 is transported, a pair of transport rollers 59 provided on the transport path 58, and a pair of registration rollers 61 provided at a position of the transport path 58 on the downstream side with respect to the pair of transport rollers 59 and on the upstream side with respect to the second-transfer position.

The transport path 58 extends from the paper container 22 through the second-transfer position to the output portion 17. The pair of registration rollers 61 transport the recording paper P to the second-transfer position in accordance with such a timing that the toner images on the intermediate transfer belt 34 reach the second-transfer position. The fixing device 60 fixes the toner images formed on the recording paper P by the image forming section 24 on the recording paper P. The fixing device 60 is provided at a position of the transport path 58 on the downstream side with respect to the second-transfer position.

The fixing device 60 includes a heat roller 60A in which a heat source (for example, a halogen lamp) is provided, and a pressure roller 60B that presses the recording paper P against the heat roller 60A while nipping the recording paper P therebetween. The heat roller 60A is provided on a side of the transport path 58 nearer to the intermediate transfer belt 34. A pair of output rollers 62 output the recording paper P having the toner images fixed thereon to the output portion 17. The pair of output rollers 62 are provided at a position of the transport path 58 on the downstream side with respect to the fixing device 60.

A reverse transport path 64 is also provided in the apparatus body 10A on a side of the transport path 58 farther from the intermediate transfer belt 34. The recording paper P having the toner images fixed thereon is turned over in the reverse transport path 64 and is transported along the reverse transport path 64 to the second-transfer position again. Plural pairs of transport rollers 65 are provided on the reverse transport path 64. When images are to be formed on both sides of the recording paper P, the recording paper P having toner images fixed on one surface thereof is switched back with the backward rotation of the pair of output rollers 62 and is guided into the reverse transport path 64. Subsequently, the recording paper P is transported to the second-transfer position via the pair of registration rollers 61. Then, image formation is performed on the back side of the recording paper P.

Apparatus Body

The apparatus body 10A will now be described.

Figure 3:
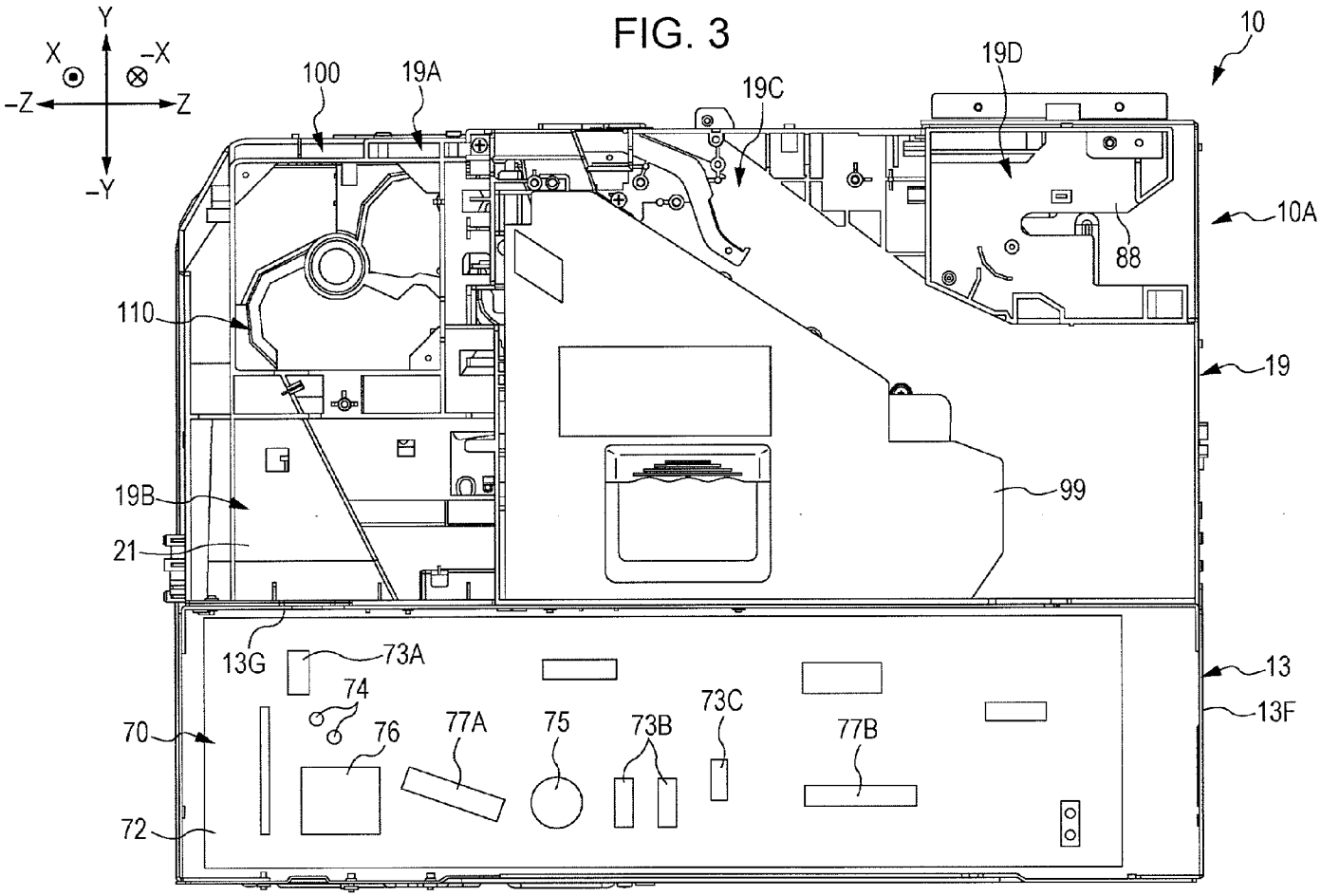
FIG. 3 is a side view of an apparatus body (with a covering member removed) of the image forming apparatus according to the exemplary embodiment of the present invention.
Figure 4:
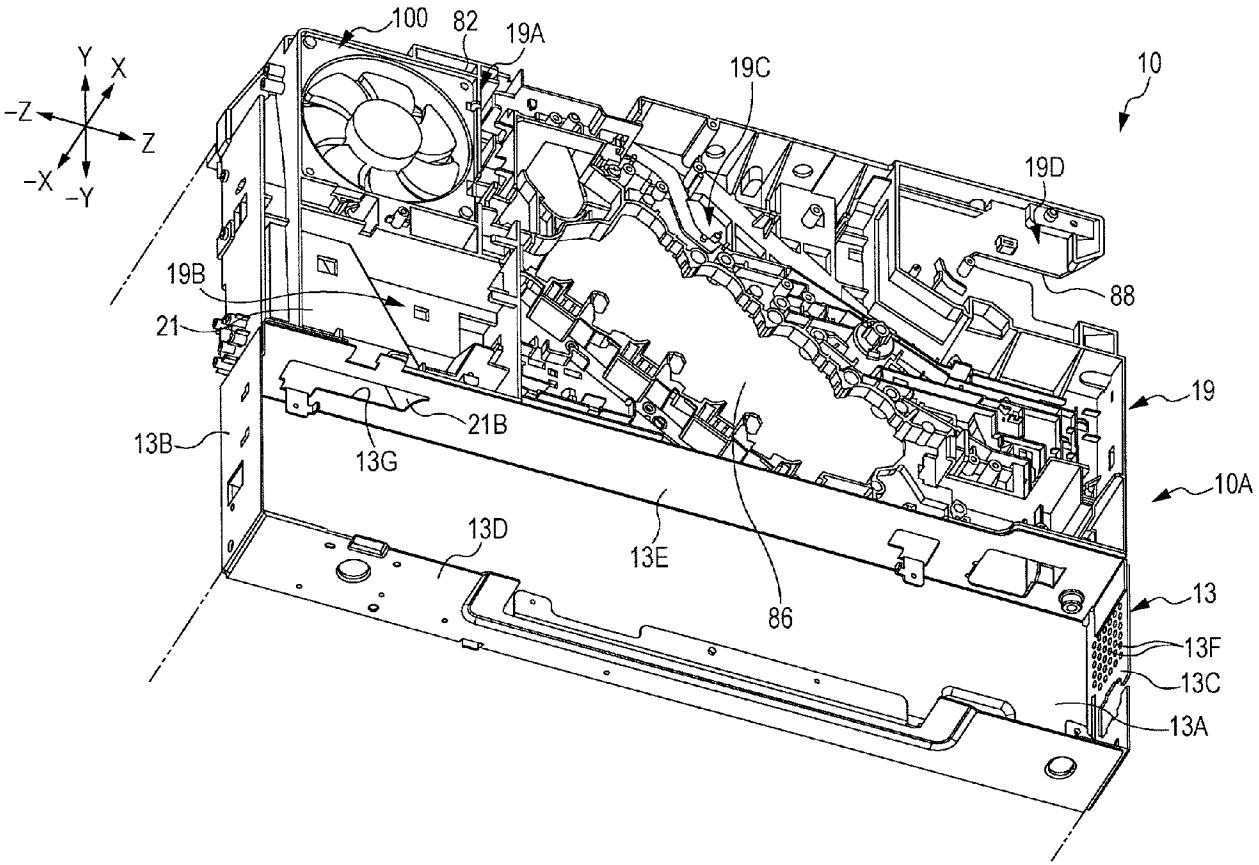
FIG. 4 is a lower perspective view of part of the apparatus body of the image forming apparatus according to the exemplary embodiment of the present invention.

Referring to FIGS. 3 and 4, the apparatus body 10A includes, at an X-direction end thereof, a rectangular lower frame 13 and an upper chassis 19. The long-side direction of the lower frame 13 corresponds to the Z direction. The upper chassis 19 is provided on the upper side, or on the Y-direction side, of the lower frame 13. The lower frame 13 and the upper chassis 19 extend in a Y-Z plane and form part of the apparatus body 10A. The apparatus body 10A further includes a side plate (not illustrated) provided at a −X-direction end thereof. Description of the side plate is omitted.

Referring to FIG. 4, the lower frame 13 includes a flat frame body 13A extending in a Y-Z plane. The frame body 13A further includes, on the periphery thereof, a front flange 13B, a rear flange 13C, a lower flange 13D, and an upper flange 13E, respectively, having rectangular shapes and extending in the X direction. The front flange 13B forms a sidewall provided on the −Z-direction side and extending in an X-Y plane. The rear flange 13C forms a sidewall provided on the Z-direction side and extending in a X-Y plane. The lower flange 13D forms a bottom wall provided on the −Y-direction side and extending in an X-Z plane. The upper flange 13E forms a top wall provided on the Y-direction side and extending in an X-Z plane. The lower frame 13 is open on the X-direction side and houses the power source section 70 (not illustrated in FIG. 4 but illustrated in FIG. 3) to be described below.

The rear flange 13C has an air outlet 13F including plural through holes extending through the rear flange 13C in the Z direction. The upper flange 13E has, at the −Z-direction end thereof, a front vent hole 13G extending through the upper flange 13E in the Y direction.

Figure 5:
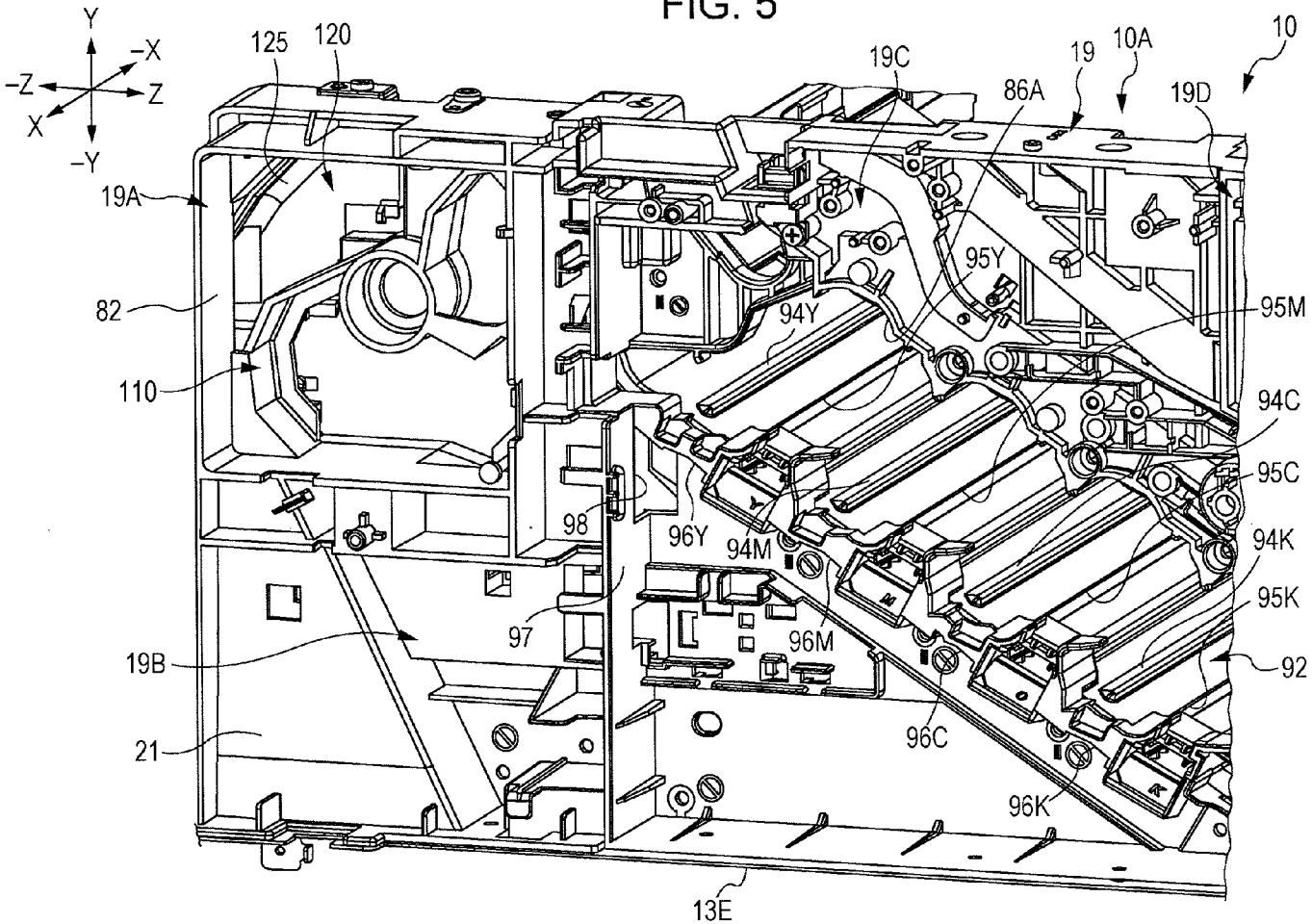
FIG. 5 is an upper perspective view of part of the apparatus body of the image forming apparatus according to the exemplary embodiment of the present invention.

Referring to FIGS. 4 and 5, the upper chassis 19 includes an air sending portion 19A in which the air sending mechanism 100, to be described below, is provided; a duct portion 19B in which air that is sent from the air sending portion 19A is guided toward the lower frame 13; a unit attaching portion 19C to which ends of the respective image forming units 32Y, 32M, 32C, and 32K are attached; and a fixing-device-attaching portion 19D to which the fixing device 60 is attached.

The air sending portion 19A is provided at the −Z-direction end and on the upper side in the Y direction and includes an attaching part 82 and a rectifying member 110 (see FIG. 9 also) to be described below. The attaching part 82 has a rectangular tubular shape. A fan 102 (see FIG. 8) to be described below is fitted into and is attached to the attaching part 82. The rectifying member 110 is provided on the −X-direction side with respect to the attaching part 82.

Figure 7:
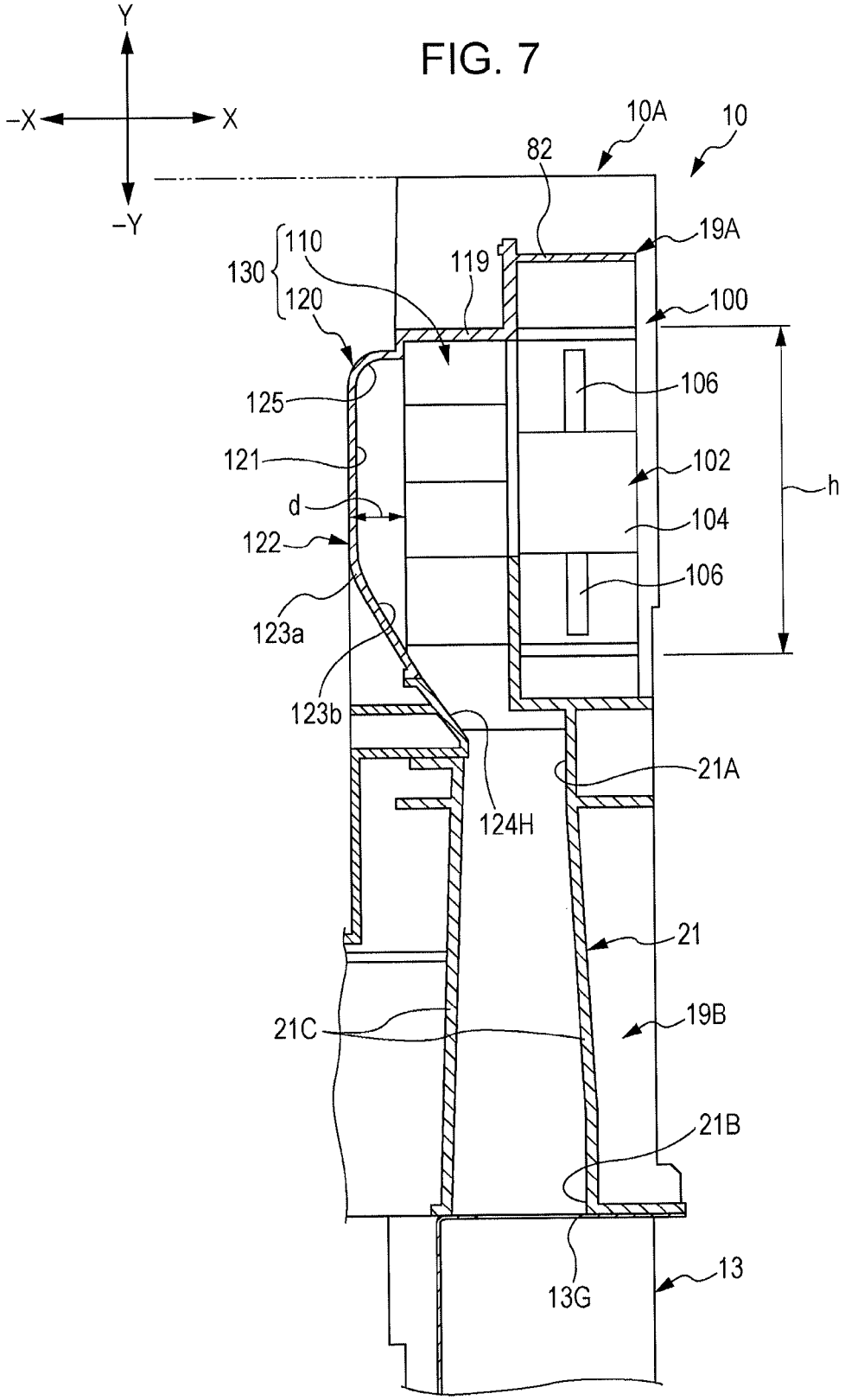
FIG. 7 illustrates another air sending path according to the exemplary embodiment of the present invention extending from an air sending fan to a power-source-side duct.

The duct portion 19B is provided on the −Y-direction side with respect to the air sending portion 19A and includes an air sending duct 21. The air sending duct 21 has a trapezoidal shape when seen in the −X direction. Referring to FIG. 7, the air sending duct 21 includes peripheral walls 21C. The peripheral walls 21C extend in a guiding direction (the −Y direction) in which a swirl flow is guided by the rectifying member 110 to be described below. The air sending duct 21 is connected to the rectifying member 110. That is, an opening 21A, which corresponds to the upper base of the trapezoidal shape, is connected to the rectifying member 110, and an opening 21B, which corresponds to the lower base of the trapezoidal shape, is connected to the front vent hole 13G. Thus, air is sent from the air sending portion 19A through the duct portion 19B into the lower frame 13.

Referring to FIG. 4, the unit attaching portion 19C is provided on the Z-direction side with respect to the air sending portion 19A and the duct portion 19B and has, in a central part thereof, an insertion hole 86 extending therethrough in the X direction. The insertion hole 86 is of a size allowing the four image forming units 32Y, 32M, 32C, and 32K (see FIG. 2) to be fitted thereinto. The insertion hole 86 has an oblong shape extending obliquely from a position near the air sending portion 19A to a position near the upper flange 13E. The four image forming units 32Y, 32M, 32C, and 32K are inserted into the insertion hole 86 in the −X direction from the X-direction side so as to be attached to the unit attaching portion 19C, and are pulled in the X direction so as to be detached from the unit attaching portion 19C.

Figure 6:
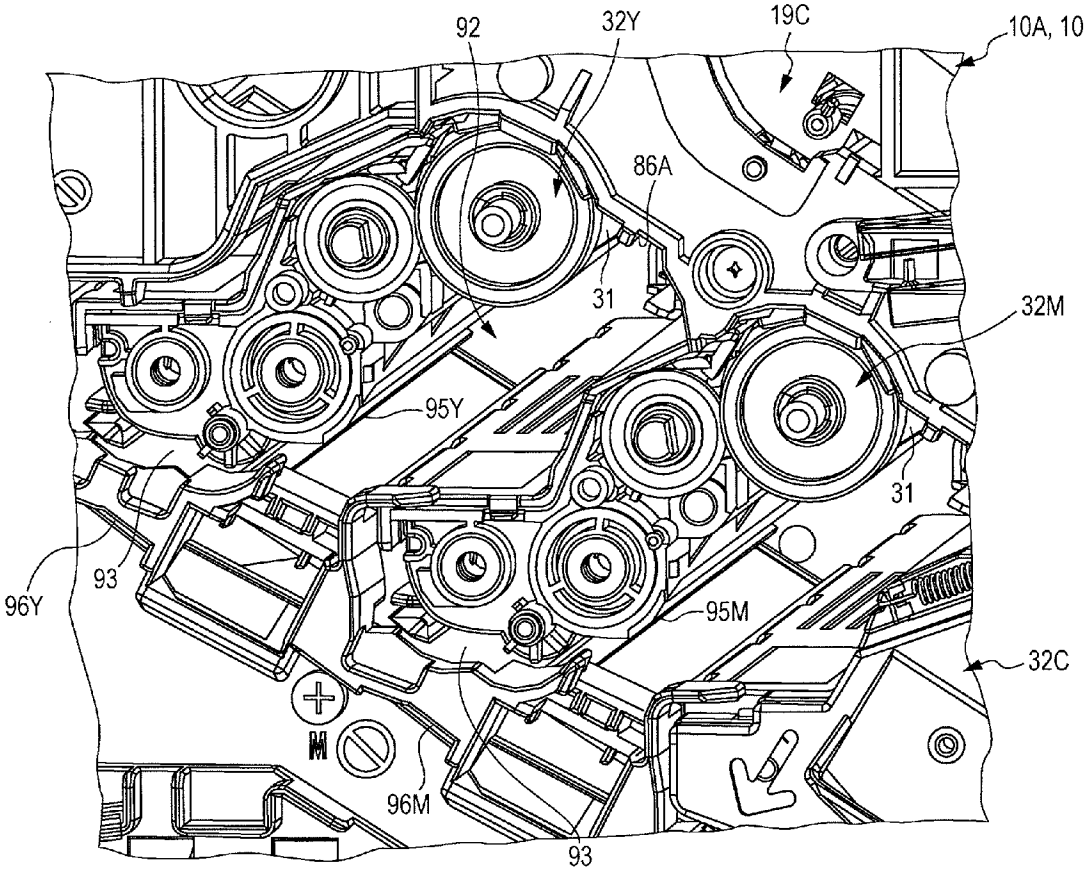
FIG. 6 is a perspective view of an air sending path according to the exemplary embodiment of the present invention provided between adjacent ones of plural image forming units.

Referring to FIGS. 5 and 6, the apparatus body 10A includes a supporting frame 92 provided on the −X-direction side with respect to the unit attaching portion 19C. The supporting frame 92 supports the image forming units 32Y, 32M, 32C, and 32K (see FIG. 2) from below.

Referring to FIG. 5, the supporting frame 92 is a metal plate member extending obliquely from a position of the unit attaching portion 19C at a −Z-direction end and on the Y-direction side to a position of the unit attaching portion 19C at a Z-direction end and on the −Y-direction side. The supporting frame 92 has, on an upper surface thereof, guide rails 94Y, 94M, 94C, and 94K that are ribs extending in the X direction. The guide rails 94Y, 94M, 94C, and 94K guide the respective image forming units 32Y, 32M, 32C, and 32K (see FIG. 2) into the apparatus body 10A. The supporting frame 92 further has light transmitting windows 95Y, 95M, 95C, and 95K through which the laser beams LB (see FIG. 2) emitted from the exposure device 42 travel. The light transmitting windows 95Y, 95M, 95C, and 95K are provided adjacent to the respective guide rails 94Y, 94M, 94C, and 94K. The light transmitting windows 95Y, 95M, 95C, and 95K are through holes that are oblong in the X direction.

The unit attaching portion 19C further has a flange 97 provided on a side thereof nearer to the air sending portion 19A and extending in the X direction. The flange 97 has an air inlet 98 that allows air flowing from the air sending portion 19A to flow into the unit attaching portion 19C. The unit attaching portion 19C further has a hole edge wall 86A and vent holes 96Y, 96M, 96C, and 96K provided below the hole edge wall 86A and extending through the unit attaching portion 19C in the X direction. Thus, air flowing from the air inlet 98 flows through the vent holes 96Y, 96M, 96C, and 96K into spaces (pseudo-ducts 93, see FIG. 6) enclosed by the bottom surfaces of the image forming units 32Y, 32M, 32C, and 32K (see FIG. 2) and the supporting frame 92.

Referring to FIG. 3, after the image forming units 32Y, 32M, 32C, and 32K (see FIG. 2) have been set in the apparatus body 10A, a waste toner tank 99 is attached to the X-direction side of the unit attaching portion 19C. The waste toner tank 99 is connected to the image forming units 32Y, 32M, 32C, and 32K and stores waste toner (not illustrated) collected from the image forming units 32Y, 32M, 32C, and 32K.

Referring to FIGS. 3 and 4, the fixing-device-attaching portion 19D is provided at the Z-direction end and on the upper side in the Y direction of the unit attaching portion 19C. The fixing-device-attaching portion 19D has a guide groove 88 that guides a pin (not illustrated) projecting in the X direction from a surface of the fixing device 60 (see FIG. 2) on the X-direction side. The guiding direction of the guide groove 88 corresponds to the Z direction. The guide groove 88 is open toward the Z-direction side.

Power Source Section

The power source section 70 will now be described.

Referring to FIG. 3, the power source section 70 includes a rectangular circuit board 72 whose long-side direction corresponds to the Z direction and whose short-side direction corresponds to the Y direction. The circuit board 72 is provided (on the X-direction side thereof) with, for example, plural circuit components including resistors (not illustrated), coils 73A, 73B, and 73C, capacitors 74, an electrolytic capacitor 75, a transformer 76, and so forth; and heat sinks 77A and 77B that cool circuit elements (not illustrated). The circuit board 72 is powered by an external power source (not illustrated) via a power supply path (not illustrated).

In the power source section 70, for example, the plural circuit components are arranged along a path of airflows C1 and D1 (see FIG. 17) to be described below extending from the front vent hole 13G to the air outlet 13F. The heat sinks 77A and 77B are oriented such that heat radiating portions thereof (not illustrated) face the path of the airflows C1 and D1.

Feature Configuration

The air sending mechanism 100 will now be described.

Referring to FIG. 7, the air sending mechanism 100 includes the fan 102, which is an exemplary air sending unit, provided in the attaching part 82 and facing the air inlet 15 (see FIG. 1); the rectifying member 110 provided on the −X-direction side of the attaching part 82 in such a manner as to be continuous with the attaching part 82 and forming the air sending portion 19A in combination with the attaching part 82; and a duct covering member 120 that is an exemplary wall member and is provided on the −X-direction side of the rectifying member 110. That is, the rectifying member 110 is provided between the fan 102 and the duct covering member 120.

Fan

The fan 102 will now be described.

Figure 8:
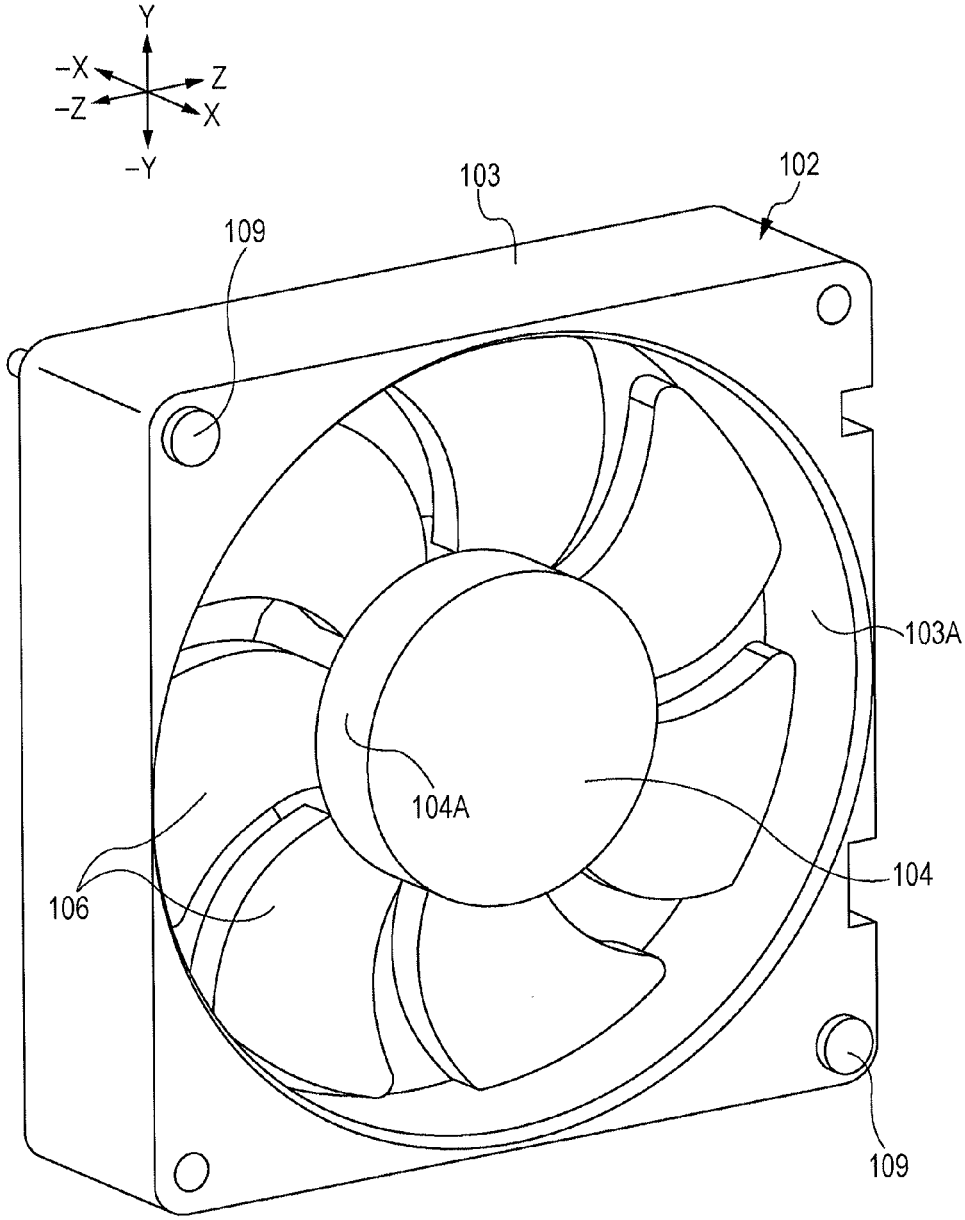
FIG. 8 is a perspective view of the air sending fan according to the exemplary embodiment of the present invention.

Referring to FIG. 8, the fan 102 is an axial-flow fan and includes a body case 103 that is of a size fittable in the attaching part 82 (see FIG. 7), a cylindrical rotating shaft 104, plural blade members 106, and a drive unit (not illustrated) provided in the rotating shaft 104 and that rotates the rotating shaft 104 when energized. The body case 103 has a hole 103A having a circular shape when seen in the −X direction and extending through the body case 103 in the −X direction. The plural blade members 106 are provided in the hole 103A. The body case 103 is fixed to the attaching part 82 (see FIG. 5) with screws 109 at the four corners thereof. The rotating shaft 104 is provided at the center of the hole 103A.

The drive unit provided in the rotating shaft 104 is supported by a supporting portion (not illustrated) extending from the −X-direction side (the back side) of the body case 103 toward the center of the hole 103A. The axial direction of the rotating shaft 104 corresponds to the X direction. The plural (seven, for example) blade members 106 are provided on an outer circumferential surface 104A of the rotating shaft 104 at certain intervals in the circumferential direction and extend radially toward the outer side. Thus, the fan 102, which is an axial-flow fan, produces a swirl flow centered at the rotating shaft 104 with the rotation of the plural blade members 106, whereby the fan 102 sends air toward the −X-direction side. The swirl flow refers to an airflow produced by the rotation of the plural blade members 106 of the fan 102 and containing not only a component flowing in the axial direction (the direction in which the rotating shaft 104 extends) but also a component flowing in the direction of rotation of the blade members 106.

Rectifying Member

The rectifying member 110 will now be described.

Figure 9:
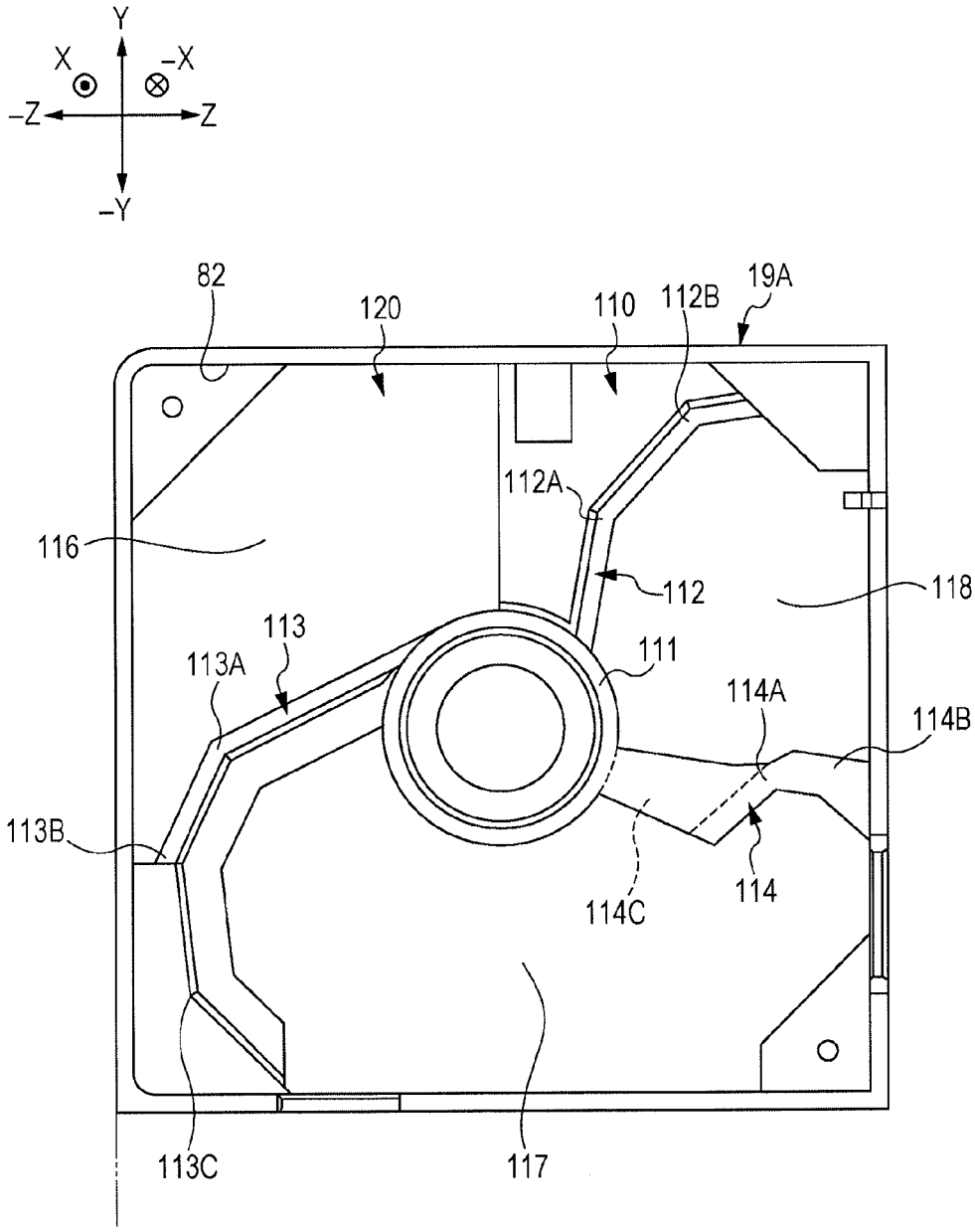
FIG. 9 is an enlarged view of a rectifying member according to the exemplary embodiment of the present invention seen in the axial direction of the air sending fan.

Referring to FIG. 9, the rectifying member 110 includes an annular portion 111 having an annular shape and being coaxial with the rotating shaft 104 (see FIG. 8) when seen in the −X direction. The rectifying member 110 further includes plural (three, for example) rectifying plates 112, 113, and 114 oriented in different directions. A sidewall 115 (see FIG. 10) and a sidewall 119 (see FIG. 7) are provided around the rectifying plates 112, 113, and 114.

The rectifying plate 112 has a certain length in the −X direction and, when seen in the −X direction, extends obliquely from the upper right of the annular portion 111 toward the upper right (in the radial direction of the rotating shaft 104 (see FIG. 8)) and has two bends 112A and 112B at which the rectifying plate 112 is angled toward the Z-direction side. The rectifying plate 112 is integrally connected to the annular portion 111. The rectifying plate 112 extends in an opposite direction (toward the −Z-direction side and then toward the −Y-direction side) with respect to a direction in which the rectifying plate 114 guides the swirl flow (toward the Z-direction side and then toward the Y-direction side). Therefore, the swirl flow is guided toward an air outlet 131 (see FIG. 12) provided on the downstream side in the opposite direction (on the downstream side in the direction of the airflow guided in the opposite direction).

The rectifying plate 113 has a certain length in the −X direction and, when seen in the −X direction, extends obliquely from the upper left of the annular portion 111 toward the lower left (in the radial direction of the rotating shaft 104 (see FIG. 8)) and has a bend 113A at which the rectifying plate 113 is angled toward the −Y-direction side and two bends 113B and 113C at which the rectifying plate 113 is angled toward the Z-direction side. The rectifying plate 113 is integrally connected to the annular portion 111.

When seen in the −X direction, the rectifying plate 114 is provided to the lower right of the annular portion 111 with a gap interposed therebetween. The rectifying plate 114 has a certain length in the −X direction. The rectifying plate 114 has a mountain shape that is convex in the Y direction with bends 114A and 114B. A portion of the rectifying plate 114 on the X-direction side extends up to the annular portion 111 and is integrally connected to the annular portion 111. That is, the rectifying plate 114 has a hole 114C provided along the outer circumferential surface of the annular portion 111.

The positions of the bends and the general angles of the rectifying plates 112, 113, and 114 are set on the basis of simulations in such a manner as to conform to the swirl flow produced by the fan 102 (see FIG. 8) (in such a manner as to guide the swirl flow in the direction of the swirl). That is, the rectifying plates 112, 113, and 114 extend along respective easement curves that are set in conformity with the swirl flow. An easement curve refers to a transition curve connecting a straight line to an arc and having a certain curvature.

The rectifying member 110 further includes a first rectifying chamber 116 as an exemplary space defined by the rectifying plate 112 and the rectifying plate 113, a second rectifying chamber 117 as an exemplary space defined by the rectifying plate 113 and the rectifying plate 114, and a third rectifying chamber 118 as an exemplary space defined by the rectifying plate 112 and the rectifying plate 114. In the present exemplary embodiment, for example, a pair of the second rectifying chamber 117 and the third rectifying chamber 118 that are adjacent to each other communicate with each other via the hole 114C provided in the rectifying plate 114.

The rectifying member 110 having such a configuration guides the swirl flow produced by the fan 102 (see FIG. 7) in intersecting directions (including the Z direction) that intersects an air sending direction (−X direction) in which the fan 102 sends air. In the present exemplary embodiment, the third rectifying chamber 118 is defined by the rectifying plate 112, the rectifying plate 114, and the sidewall 115 (see FIG. 10), which is provided on the Z-direction side. Therefore, as described below, some of the swirl flow produced by the fan 102 is further swirled and is guided in a direction different from the direction of the swirl.

Figure 10:
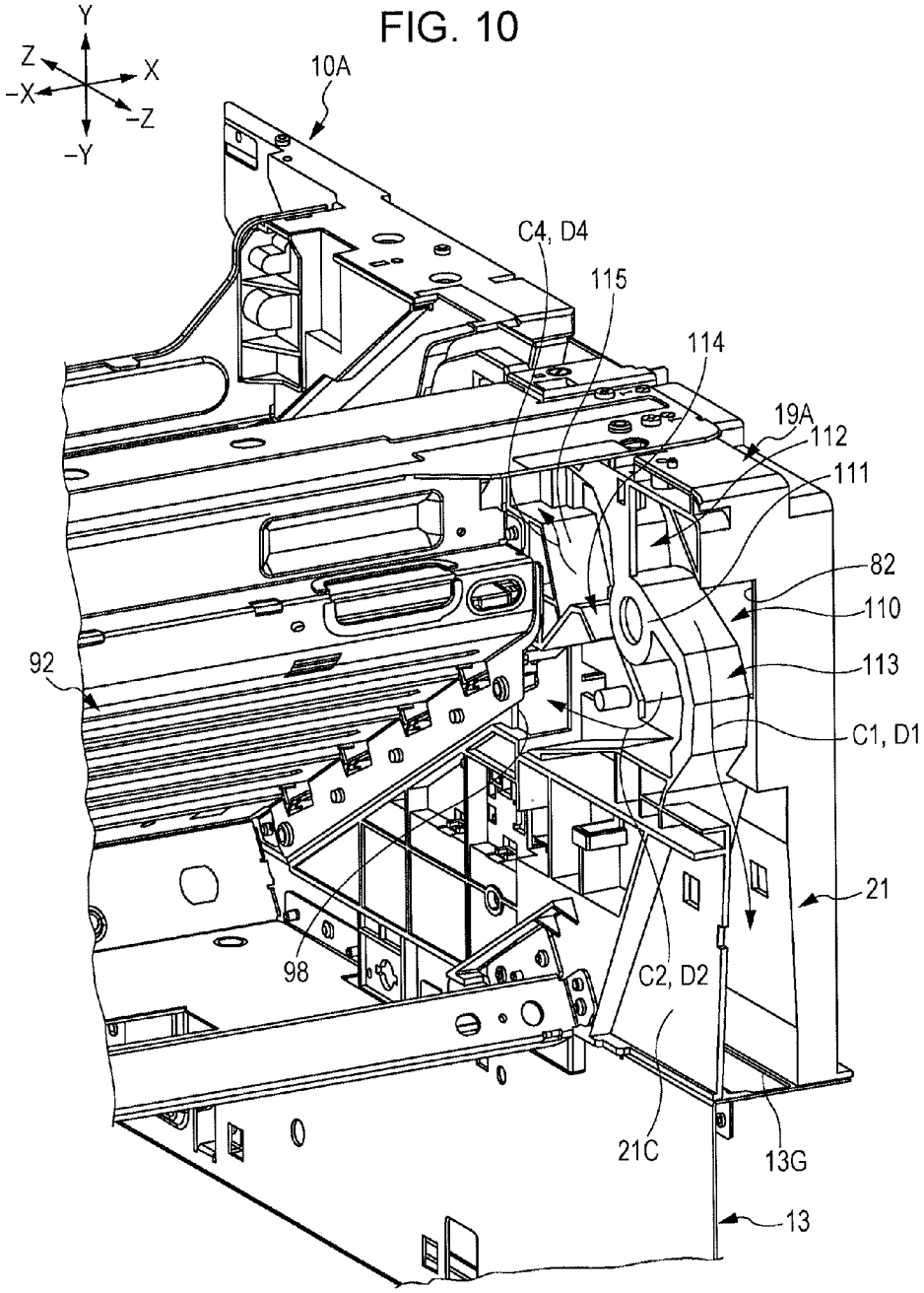
FIG. 10 is a perspective view of the rectifying member according to the exemplary embodiment of the present invention seen from the inner side of the apparatus body.

Referring to FIG. 7, the rectifying member 110 covers a space defined between a surface of the fan 102 on the air sending side (the −X-direction side) and a facing surface 121 of the duct covering member 120 and is connected to the duct covering member 120, whereby a branching duct 130 as an exemplary duct is provided. When seen in the direction in which the rotating shaft 104 of the fan 102 extends (in the X direction), the rectifying member 110 faces an area (a circular area) in which the blade members 106 of the fan 102 rotate. Referring to FIG. 10, the air sending duct 21 defined by the peripheral walls 21C is connected to the rectifying member 110, as described above.

Duct Covering Member

The duct covering member 120 will now be described.

Figure 11:
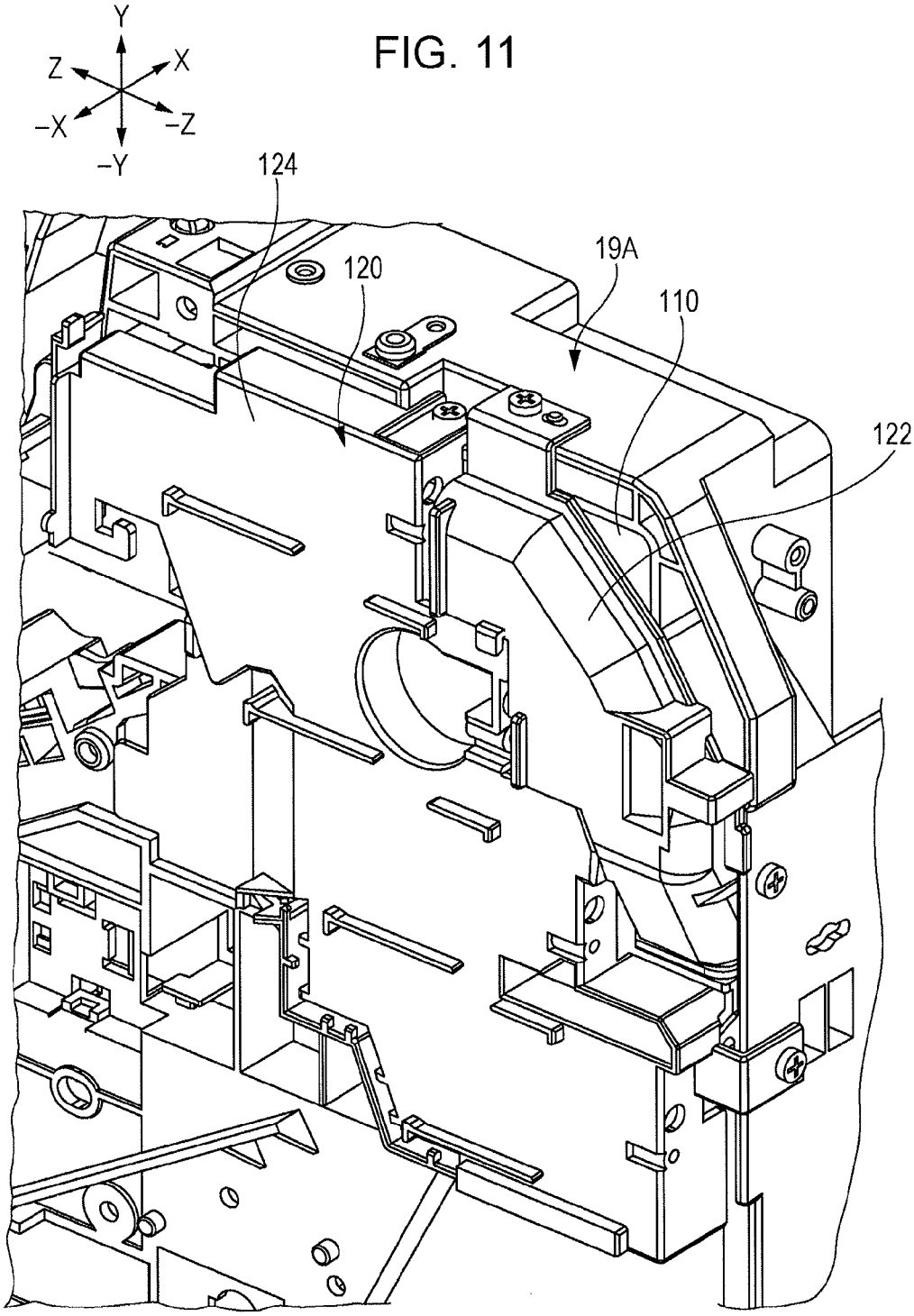
FIG. 11 is a perspective view of a duct frame and a duct base according to the exemplary embodiment of the present invention seen from the inner side of the apparatus body.

Referring to FIG. 11, the duct covering member 120 is attached to the air sending portion 19A in such a manner as to cover the −X-direction side of the rectifying member 110. The duct covering member 120 includes a duct frame 122 that guides the swirl flow (airflow) toward the air sending duct 21 (see FIG. 7) described above, and a duct base 124 that guides the swirl flow (airflow) toward the unit attaching portion 19C or toward an intermediate-transfer-side duct 140 (see FIG. 12), to be described below, via the air inlet 98 (see FIG. 10).

Figure 12:
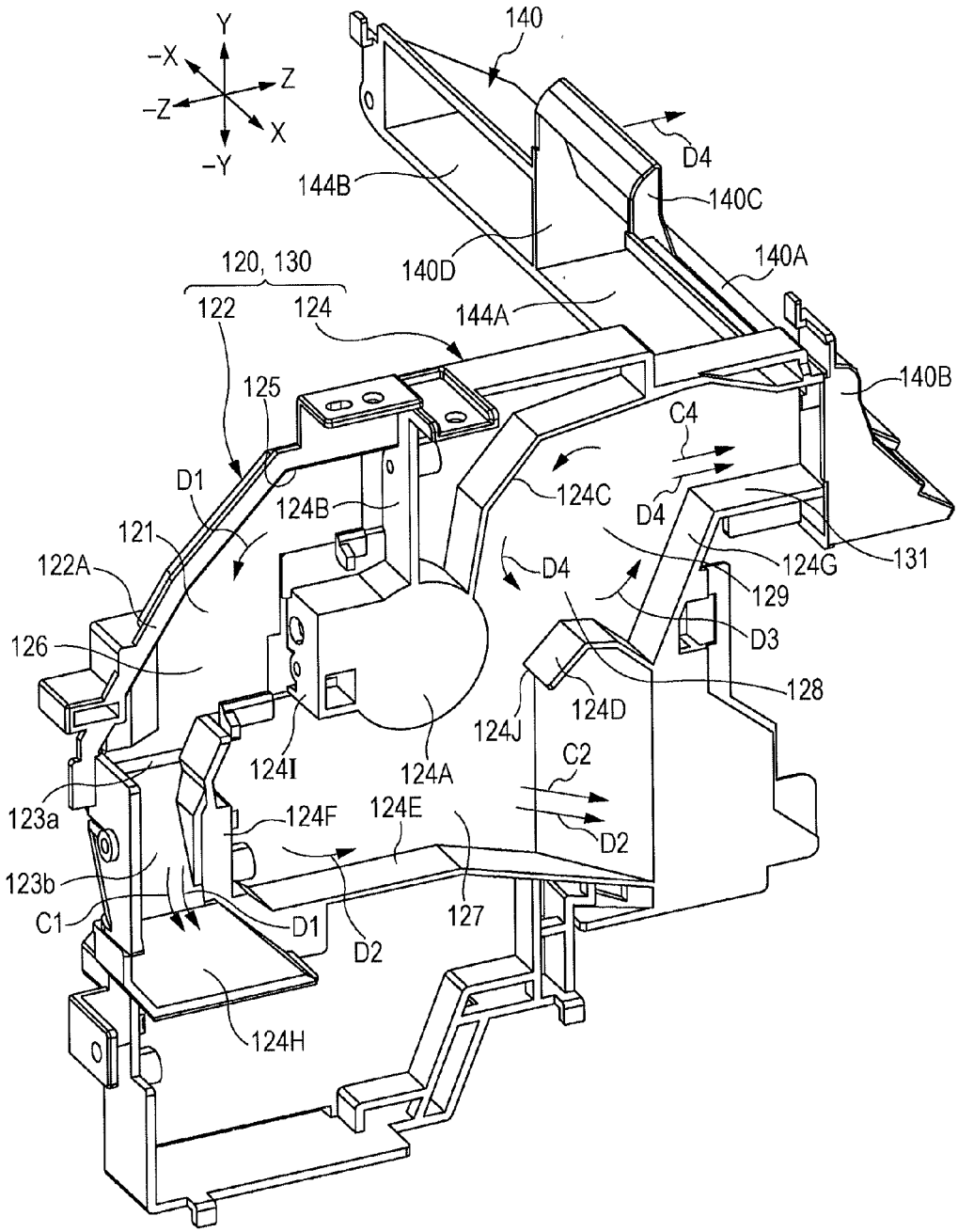
FIG. 12 is a perspective view of the duct frame and the duct base according to the exemplary embodiment of the present invention seen from a side thereof nearer to the rectifying member.
Figure 13:
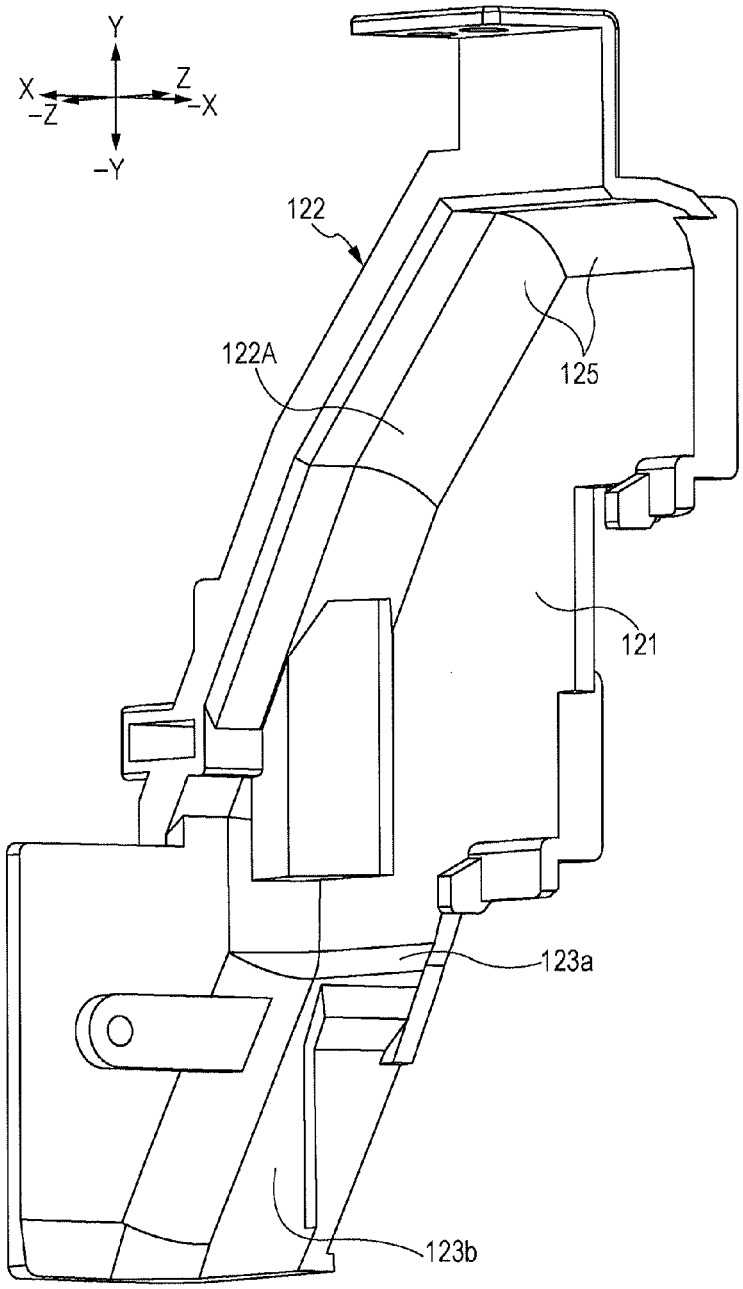
FIG. 13 is a perspective view of the duct frame according to the exemplary embodiment of the present invention.

Referring to FIGS. 12 and 13, the duct frame 122 includes the facing surface 121 that faces the fan 102 (see FIG. 7), a curved surface 125 as an exemplary guiding surface, and a curved surface 123*b* as another exemplary guiding surface. The duct frame 122 further includes a sidewall 122A whose width direction corresponds to the X direction and, when seen in the −X direction, extending from the upper side in the Y direction toward the −Z-direction side. A portion of the duct frame 122 from the −Y-direction side to the Z-direction side is open. When the duct frame 122 is attached to the duct base 124, the open portion is closed, whereby a first guiding chamber 126 is provided.

The facing surface 121 of the duct frame 122 extends in a Y-Z plane. The curved surface 125 is continuous with the Y-direction end (upper end) of the facing surface 121. The curved surface 125 has an arc shape curving from the Y-direction side toward the −X-direction side. Therefore, air flowing in the −X direction is guided in the −Y direction, which is an exemplary intersecting direction, by the curved surface 125.

Referring to FIG. 7, the curved surface 123*b* is continuous with the −Y-direction end (lower end) of the facing surface 121. The Y-direction end of the curved surface 123*b* (the lower end of the facing surface 121) forms a curve 123*a*.

The curve 123*a* and the curved surface 123*b* curve toward the fan 102 (toward the X-direction side). Therefore, the air flowing from the fan 102 over the rectifying member 110 into the duct covering member 120 is guided along both the facing surface 121 and the curved surface 125 and flows in the X direction and in the −Y direction. The duct covering member 120 has an X-direction width d that is smaller than a Y-direction height h of the fan 102. For example, h=92 mm, and d=32 mm.

Referring to FIG. 12, the duct base 124 includes a facing surface 128 that faces the fan 102 (see FIG. 7). A columnar round portion 124A is provided in a −Z-direction central part of the facing surface 128. The round portion 124A has substantially the same outside diameter as the annular portion 111 (see FIG. 9) and is coaxial with the center axis of the annular portion 111.

When seen in the −X direction, the duct base 124 includes a partition wall 124B provided above the round portion 124A and standing upright in the Y direction, and a guide wall 124C provided on the upper right of the round portion 124A and being in contact with the rectifying plate 112 (see FIG. 9) with no gap therebetween. The partition wall 124B separates the duct frame 122 and the duct base 124 from each other. The guide wall 124C guides air toward the intermediate-transfer-side duct 140 to be described below.

When seen in the −X direction, the duct base 124 further includes a partition wall 124D spaced apart from the round portion 124A in the Z direction and residing on the −Y-direction side with respect to the round portion 124A. The partition wall 124D is in contact with the rectifying plate 114 (see FIG. 9) with no gap therebetween. The duct base 124 further includes a guide wall 124E spaced apart from and on the −Y-direction side with respect to the round portion 124A and extending in the Z direction. The partition wall 124D divides the internal space of the duct base 124 and guides air toward the unit attaching portion 19C (see FIG. 3).

When seen in the −X direction, the duct base 124 further includes a partition wall 124F provided at the −Z-direction end of the guide wall 124E and standing upright in the Y direction, and a guide wall 124G provided at the Z-direction end of the partition wall 124D and extending obliquely toward the upper right. The partition wall 124F separates the duct frame 122 and the duct base 124 from each other. The guide wall 124G guides air toward the intermediate-transfer-side duct 140 in combination with the guide wall 124C.

The duct base 124 further includes a guide wall 124H provided on the lower side (−Y-direction side) with respect to the curved surface 125 of the duct frame 122. Air flowing along the curved surface 125 is guided toward the air sending duct 21 (see FIG. 7) by the guide wall 124H.

The duct base 124 further includes a second guiding chamber 127 defined by the round portion 124A, the partition wall 124F, the partition wall 124D, and the guide wall 124E and a third guiding chamber 129 defined by the round portion 124A, the guide wall 124C, the partition wall 124D, and the guide wall 124G. The first guiding chamber 126 and the second guiding chamber 127 communicate with each other via an opening 124I. The second guiding chamber 127 and the third guiding chamber 129 communicate with each other via a hole 124J provided between the round portion 124A and the partition wall 124D.

Intermediate-Transfer-Side Duct

The intermediate-transfer-side duct 140 will now be described.

Referring to FIG. 2, the intermediate-transfer-side duct 140 is provided between the controller 20 and the cleaning unit 57 and extends in the X direction, with an air sending port 142 thereof facing toward the upper side of the intermediate transfer belt 34.

Figure 14A:
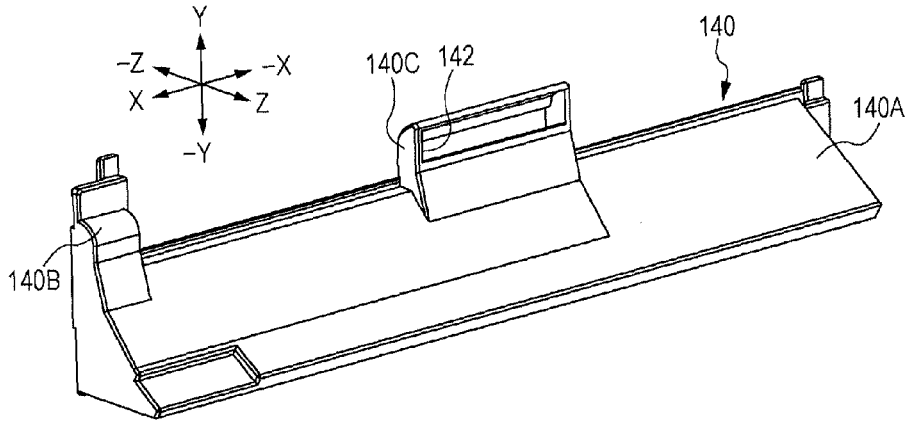
FIGS. 14A and 14B are perspective views of an intermediate-transfer-side duct according to the exemplary embodiment of the present invention seen from the outer and inner sides thereof, respectively.
Figure 14B:
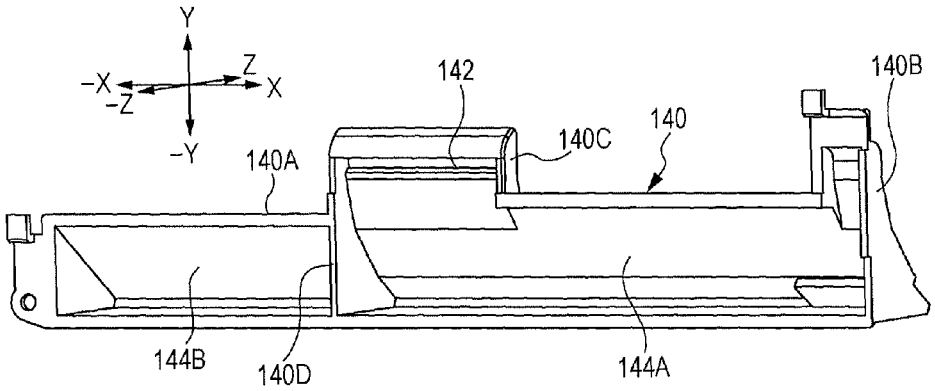

Referring to FIGS. 14A and 14B, the intermediate-transfer-side duct 140 includes a body portion 140A having a substantially triangular Y-Z cross-sectional shape and extending in the X direction, a connecting portion 140B provided at the X-direction end of the body portion 140A and projecting in the Y direction, and an air sending portion 140C provided in the X-direction central part of the body portion 140A and projecting in the Y direction.

Referring to FIG. 14B, the body portion 140A is open on the −Z-direction side thereof, which is closed by a lid member (not illustrated). The body portion 140A has a partition wall 140D provided thereinside and extending in the −Y direction in a Y-Z plane from a position of a wall of the air sending portion 140C on the −X-direction side. The partition wall 140D divides the internal space of the body portion 140A into an air sending chamber 144A that allows air to flow therethrough and a small chamber 144B that does not allow air to flow therethrough.

The connecting portion 140B is connected to the Z-direction ends of the guide walls 124C and 124G (see FIG. 12) of the duct covering member 120. Therefore, air is allowed to flow from the third guiding chamber 129 provided in the duct covering member 120 into the air sending chamber 144A.

Referring to FIG. 14A, the air sending portion 140C has the above-mentioned air sending port 142 provided on the Z-direction side thereof. The air sending port 142 extends in the X direction and opens toward the Z-direction side. Therefore, air flowing from the duct covering member 120 (see FIG. 12) into the air sending chamber 144A (see FIG. 14B) is allowed to flow upward from the air sending port 142 toward the upper side of the intermediate transfer belt 34 (see FIG. 2).

Image Forming Operation

An image forming operation performed by the image forming apparatus 10 will now be described.

Referring to FIG. 2, in the image forming apparatus 10, the recording paper P fed from the paper container 22 by the feed roller 56 is transported by the pair of transport rollers 59 and is then transported to the second-transfer position by the pair of registration rollers 61.

Meanwhile, in the image forming units 32Y, 32M, 32C, and 32K, the photoconductors 31 charged by the respective charging rollers 33 undergo exposure performed by the exposure device 42, whereby electrostatic latent images are formed on the respective photoconductors 31. The electrostatic latent images are developed by the respective developing devices 44, whereby toner images are formed on the respective photoconductors 31. The toner images in different colors thus formed by the image forming units 32Y, 32M, 32C, and 32K are superposed one on top of another on the intermediate transfer belt 34 at the respective first-transfer positions, whereby a color image is formed. The color image is then transferred to the recording paper P at the second-transfer position.

The recording paper P having the color image transferred thereto is transported to the fixing device 60, where the color image is fixed. In a case where an image is to be formed only on the front side (one side) of the recording paper P, the recording paper P having undergone the fixing of the image is output to the output portion 17 by the pair of output rollers 62. In a case where images are to be formed on both sides of the recording paper P, the recording paper P having an image formed on one side thereof is switched back by the pair of output rollers 62 and is transported into the reverse transport path 64. Subsequently, the recording paper P is transported from the reverse transport path 64 to the second-transfer position again. Then, after another image is formed in the manner as described above on the other side (back side) of the recording paper P having no image yet, the recording paper P is output to the output portion 17 by the pair of output rollers 62. The image forming operation is thus complete.

Functional Operations

Functional operations realized in the present exemplary embodiment will now be described.

Figure 15:
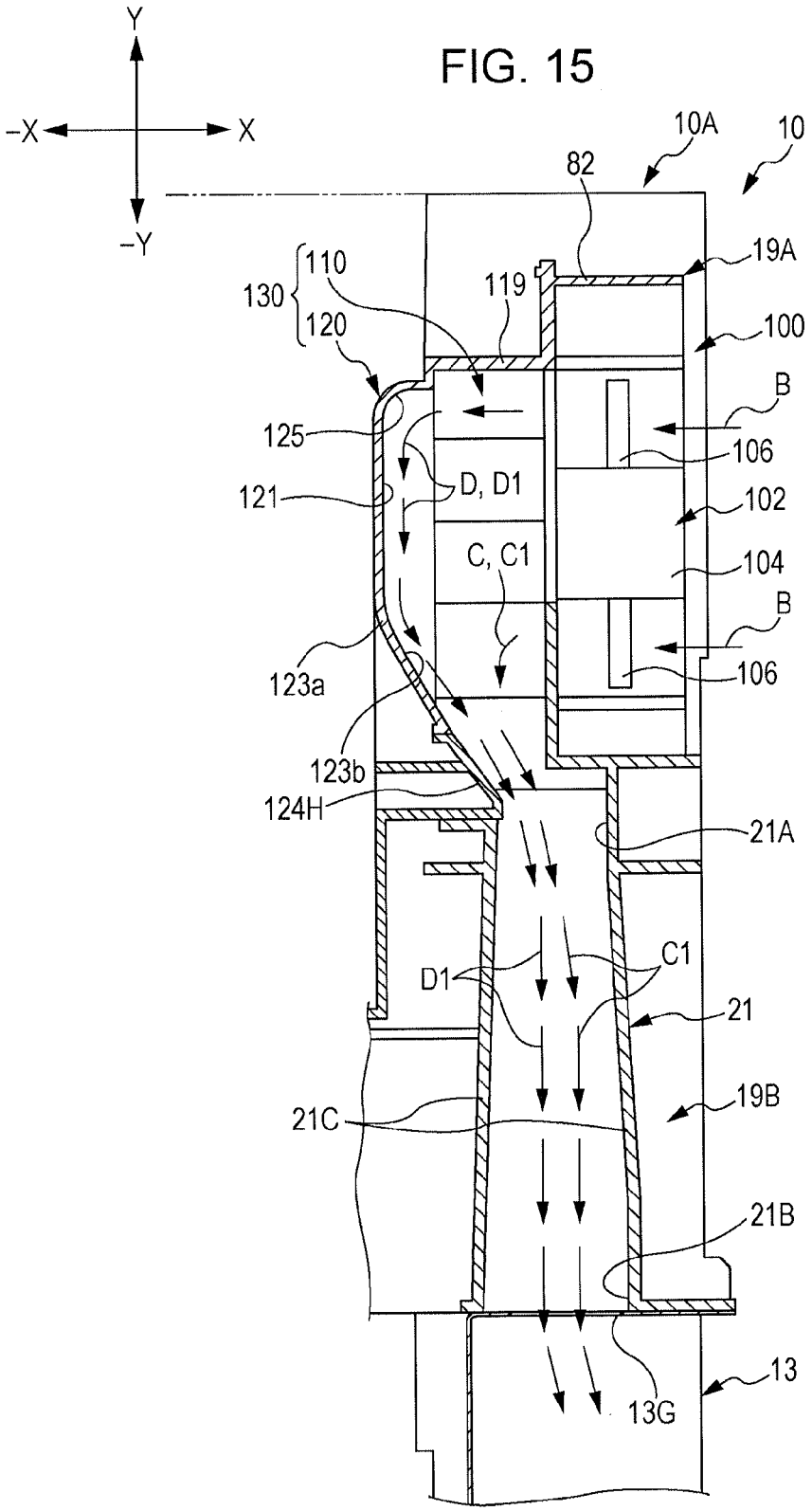
FIG. 15 illustrates how air is sent from the air sending fan to the power-source-side duct in the exemplary embodiment of the present invention.

Referring to FIG. 15, when the fan 102 is driven and the rotating shaft 104 and the plural blade members 106 rotate, air is taken in (as represented by arrows B) from the air inlet 15 (see FIG. 1) and the fan 102 produces a swirl flow (as represented by arrows C and D) in the branching duct 130. The swirl flow includes a swirl flow C produced in the rectifying member 110 and a swirl flow D produced in the duct covering member 120. Hereinafter, the swirl flows C and D are each denoted with different numerical suffixes for distinguishing among different flows.

Figure 16A:
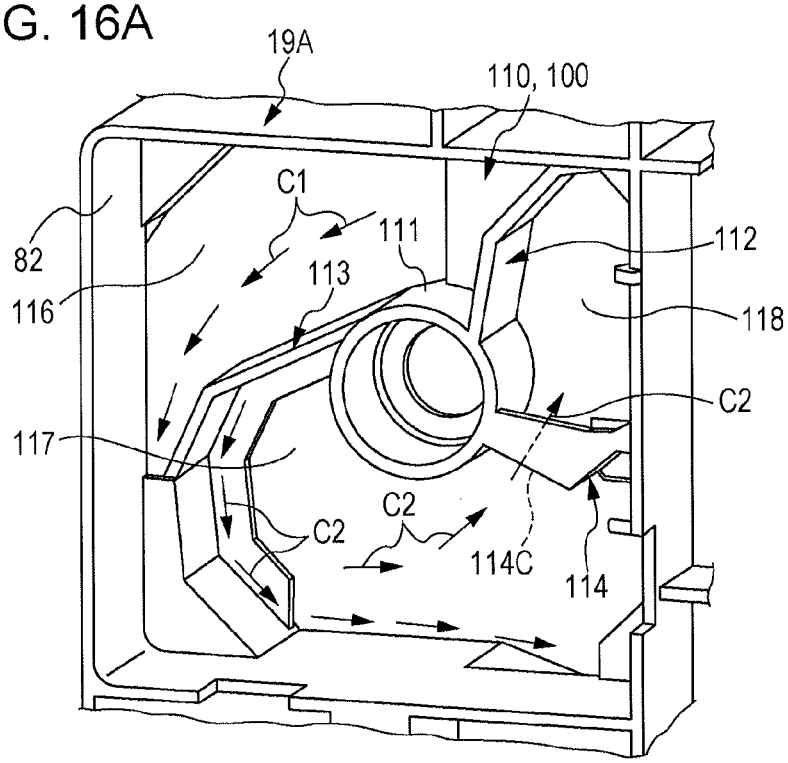
FIGS. 16A and 16B are perspective views of the rectifying member according to the exemplary embodiment of the present invention.

Referring to FIG. 16A, a swirl flow C1 is produced in the first rectifying chamber 116 of the rectifying member 110 and is guided by the rectifying plate 113 toward the downstream side (toward the air sending duct 21 (see FIG. 15)). Meanwhile, a swirl flow C2 is produced in the second rectifying chamber 117 and is guided by the rectifying plate 113 and the rectifying plate 114 toward the downstream side (toward the unit attaching portion 19C (see FIG. 17)). Here, some of the swirl flow C2 flows through the hole 114C into the third rectifying chamber 118.

Figure 16B:
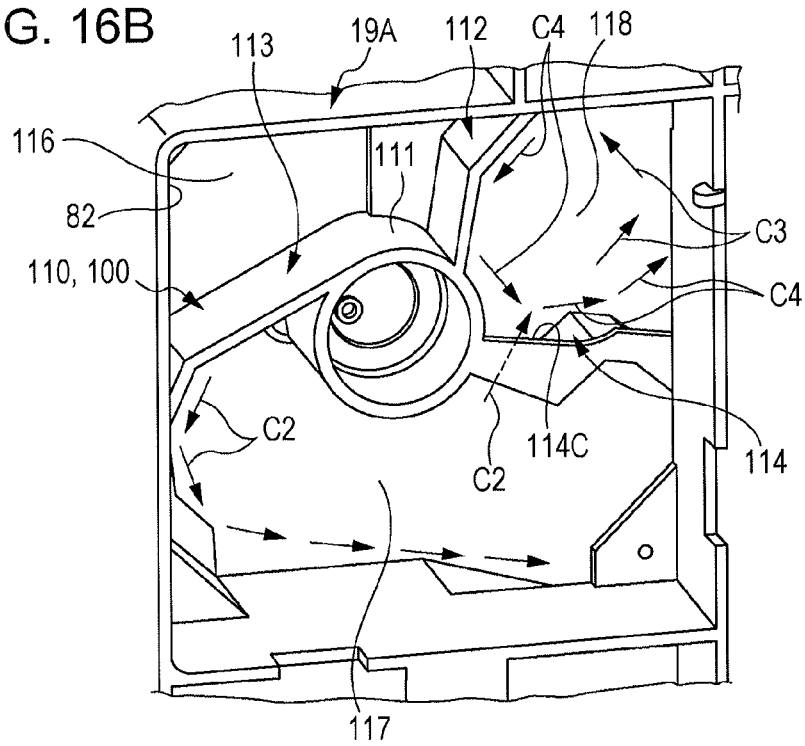

Referring now to FIG. 16B, in the third rectifying chamber 118, a swirl flow C3 produced by the air directly flowed into the third rectifying chamber 118 and the swirl flow C2 flowed from the second rectifying chamber 117 are swirled (guided) together by the rectifying plate 112 and the rectifying plate 114, whereby a swirl flow C4 is produced. Subsequently, the swirl flow C4 is guided toward the downstream side (toward the intermediate-transfer-side duct 140 (see FIG. 18)). Although some of the swirl flow C3 may directly flow toward the downstream side, such a swirl flow C3 is omitted and the swirl flow C4 is only illustrated.

As described above, in the air sending mechanism 100, the swirl flows C1, C2, and C3 produced by the fan 102 (see FIG. 15) are guided by the rectifying plate 112, the rectifying plate 113, and the rectifying plate 114 of the rectifying member 110 and further flow while swirling in the intersecting direction that intersects the air sending direction. Therefore, despite the duct covering member 120 being provided near the fan 102, the resistance in sending air is reduced. Consequently, the air pressure loss occurring in sending air in the intersecting direction that intersects the air sending direction is reduced.

Referring to FIG. 10, the rectifying member 110 is surrounded by the walls of the air sending portion 19A, including the sidewall 115 and the sidewall 119 (see FIG. 7), and the space between the surface of the fan 102 (see FIG. 15) on the air sending side and the facing surfaces 121 and 128 (see FIG. 12) of the duct covering member 120 is covered. Therefore, the leakage of air from between the fan 102 and the duct covering member 120 is reduced.

The rectifying member 110 includes the rectifying plate 112, the rectifying plate 113, and the rectifying plate 114. Therefore, the swirl flow produced by the fan 102 is sent in plural directions along the rectifying plate 112, the rectifying plate 113, and the rectifying plate 114.

Referring to FIG. 15, the rectifying member 110 is provided in such a manner as to face the area where the blade members 106 of the fan 102 rotate when seen in the direction in which the rotating shaft 104 of the fan 102 extends (in the X direction). Therefore, the air sending mechanism 100 has a smaller size than in a case where the blade members 106 and the rectifying member 110 do not face each other.

Referring to FIG. 16B, in the air sending mechanism 100, the swirl flow is further swirled in the third rectifying chamber 118, producing the swirl flow C4 that swirls in a guiding direction (a direction toward the intermediate-transfer-side duct 140 (see FIG. 18)) that is different from (opposite to) the direction of the swirl flow C3. The swirl flow C4 thus produced flows toward the air outlet 131. Therefore, it is easier to send the swirl flow C3 in a direction (Z direction) in which the swirl flow C3 is difficult to redirect than in a case where the swirl flow C is not further swirled.

In the air sending mechanism 100, the second rectifying chamber 117 and the third rectifying chamber 118 communicate with each other via the hole 114C. Therefore, the amount of airflow (swirl flow) produced in the third rectifying chamber 118 is larger than in a case where the second rectifying chamber 117 and the third rectifying chamber 118 do not communicate with each other. Hence, the amount of air sent in a certain direction (toward the intermediate-transfer-side duct 140 in the present exemplary embodiment) increases. Furthermore, the swirl flow C2 flowing from the hole 114C into the third rectifying chamber 118 pushes up, from the −Y-direction side, the airflow swirling in the third rectifying chamber 118, making it easier to send the air in the third rectifying chamber 118 in the guiding direction (toward the intermediate-transfer-side duct 140 (see FIG. 18)).

Meanwhile, in the first guiding chamber 126 provided in the duct covering member 120 illustrated in FIG. 12, the swirl flow D1 flowed into the first guiding chamber 126 and whose direction has been changed from the −X direction to the −Y direction by the duct frame 122 is guided toward the downstream side (toward the air sending duct 21 (see FIG. 15)) by the curved surface 125. Furthermore, in the second guiding chamber 127, a swirl flow D2 flowed into the second guiding chamber 127 and whose direction has been changed from the −X direction to the −Y direction by the duct base 124 is guided toward the downstream side (toward the unit attaching portion 19C (see FIG. 17)) by the guide wall 124E. Here, some of the swirl flow D2 flows through the hole 124J into the third guiding chamber 129.

Furthermore, in the third guiding chamber 129, a swirl flow D3 directly flowed into the third guiding chamber 129 and the swirl flow D2 flowed from the second guiding chamber 127 are swirled (guided) together by the guide wall 124C, whereby a swirl flow D4 is produced. The swirl flow D4 is then guided toward the downstream side (toward the intermediate-transfer-side duct 140 (see FIG. 18)). Although some of the swirl flow D3 may directly flow toward the downstream side, such a swirl flow D3 is omitted and the swirl flow D4 is only illustrated.

Referring to FIG. 15, in the air sending mechanism 100, the rectifying member 110 and the duct covering member 120 are connected to each other and form the branching duct 130. Therefore, the leakage of air is smaller and it is easier to send air in preset directions than in a case in which the rectifying member 110 and the duct covering member 120 are not connected to each other.

In the air sending mechanism 100, the duct covering member 120 includes the curved surface 125. Therefore, air (including the swirl flow) flowed from the rectifying member 110 into the duct covering member 120 flows along the curved surface 125. This suppresses the reduction in the pressure of the airflow. Hence, it is easy to guide air in the intersecting direction (−Y direction) that intersects the air sending direction.

In the air sending mechanism 100, the curved surface 125 is curved toward the fan 102. Therefore, while the air pressure loss is reduced, the air flowed from the fan 102 toward the downstream side is also sent to the periphery of the fan 102.

Subsequently, the swirl flows C1 and D1 flow toward the air sending duct 21 (see FIG. 15), the swirl flows C2 and D2 flow toward the unit attaching portion 19C (see FIG. 17), and the swirl flows C4 and D4 flow toward the intermediate-transfer-side duct 140. On the outer side of the rectifying member 110 and on the outer side of the duct covering member 120, the swirl flows C1, C2, C4, D1, D2, and D4 are referred to as airflows C1, C2, C4, D1, D2, and D4, correspondingly.

Subsequently, referring to FIG. 17, the airflows C1 and D1 flowed from the air sending duct 21 through the front vent hole 13G into the lower frame 13 flow near the plural circuit components including the coils 73A, 73B, and 73C, the capacitors 74, the electrolytic capacitor 75, the transformer 76, and so forth provided in the power source section 70, and absorb heat from the circuit components before being exhausted to the outside from the air outlet 13F. In the heat sinks 77A and 77B that face the path of the airflows C1 and D1, the heat releasing effect is enhanced by the airflows C1 and D1.

Referring now to FIG. 15, the rectifying member 110 is connected to the air sending duct 21 defined by the peripheral walls 21C extending in the guiding direction in which the swirl flow is guided by the rectifying member 110. Therefore, the air pressure loss in sending air that occurs on the downstream side with respect to the rectifying member 110 is smaller than in a case where the peripheral walls 21C do not extend in the direction in which the swirl flow is guided.

Figure 17:
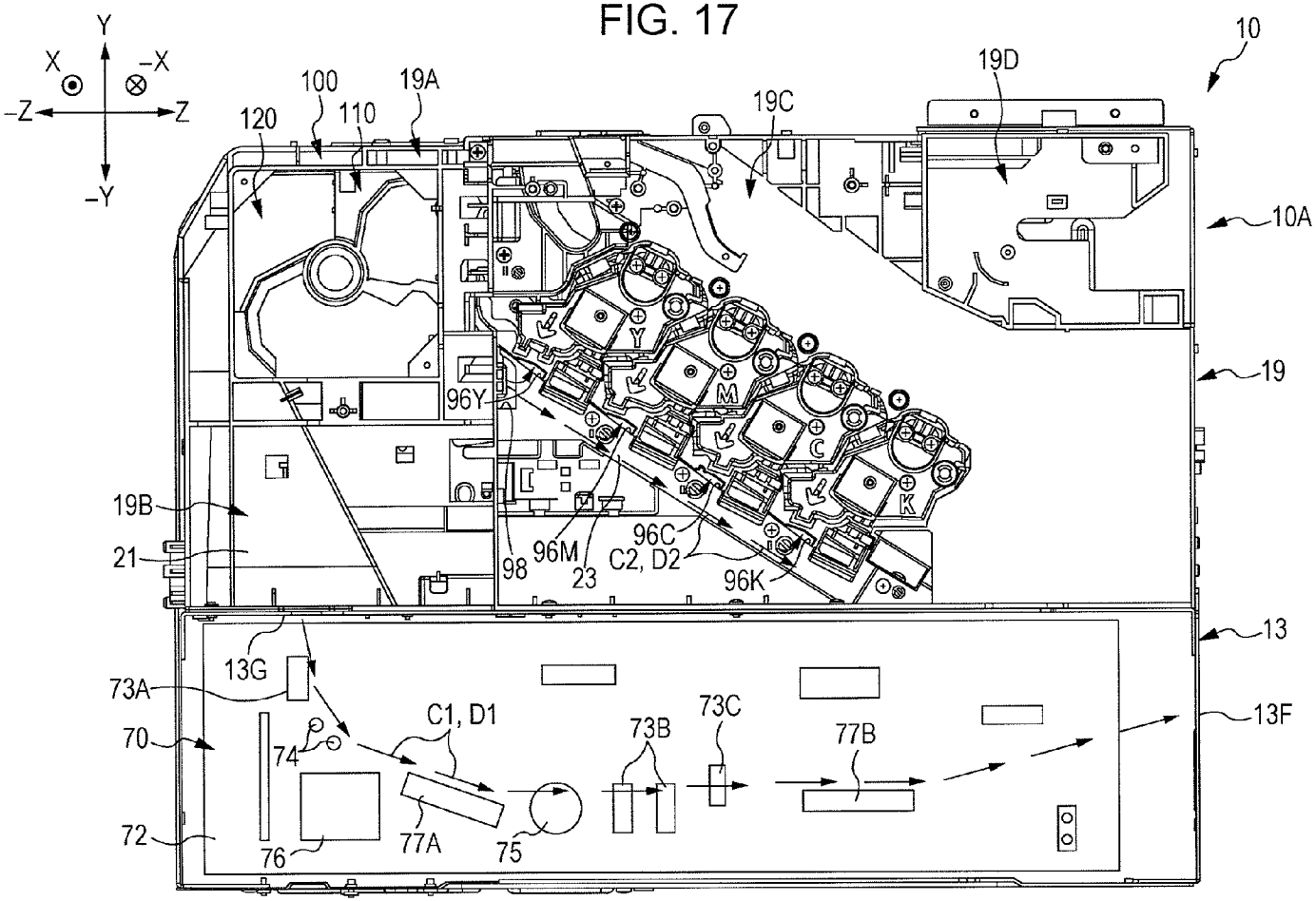
FIG. 17 illustrates how air flows in a side portion of the image forming apparatus in the exemplary embodiment of the present invention.

Referring now to FIG. 17, the airflows C2 and D2 flowed from the rectifying member 110 and the duct covering member 120 through the air inlet 98 into the unit attaching portion 19C further flow in the Z direction while angled toward the −Y-direction side through a pseudo-duct 23 defined by the waste toner tank 99 (see FIG. 3) and plural flanges (not illustrated) projecting in the X direction. Thus, the airflows C2 and D2 reach the vent holes 96Y, 96M, 96C, and 96K. Subsequently, referring to FIGS. 6 and 17, the airflows C2 and D2 flow through the vent holes 96Y, 96M, 96C, and 96K into the pseudo-ducts 93 and further flow in the −X direction. Subsequently, referring to FIG. 19, the airflows C2 and D2 go upward in the Y direction at a side plate (not illustrated) provided at the −X-direction end of the image forming apparatus 10, and is exhausted from the left air outlet 16A.

Figure 18:
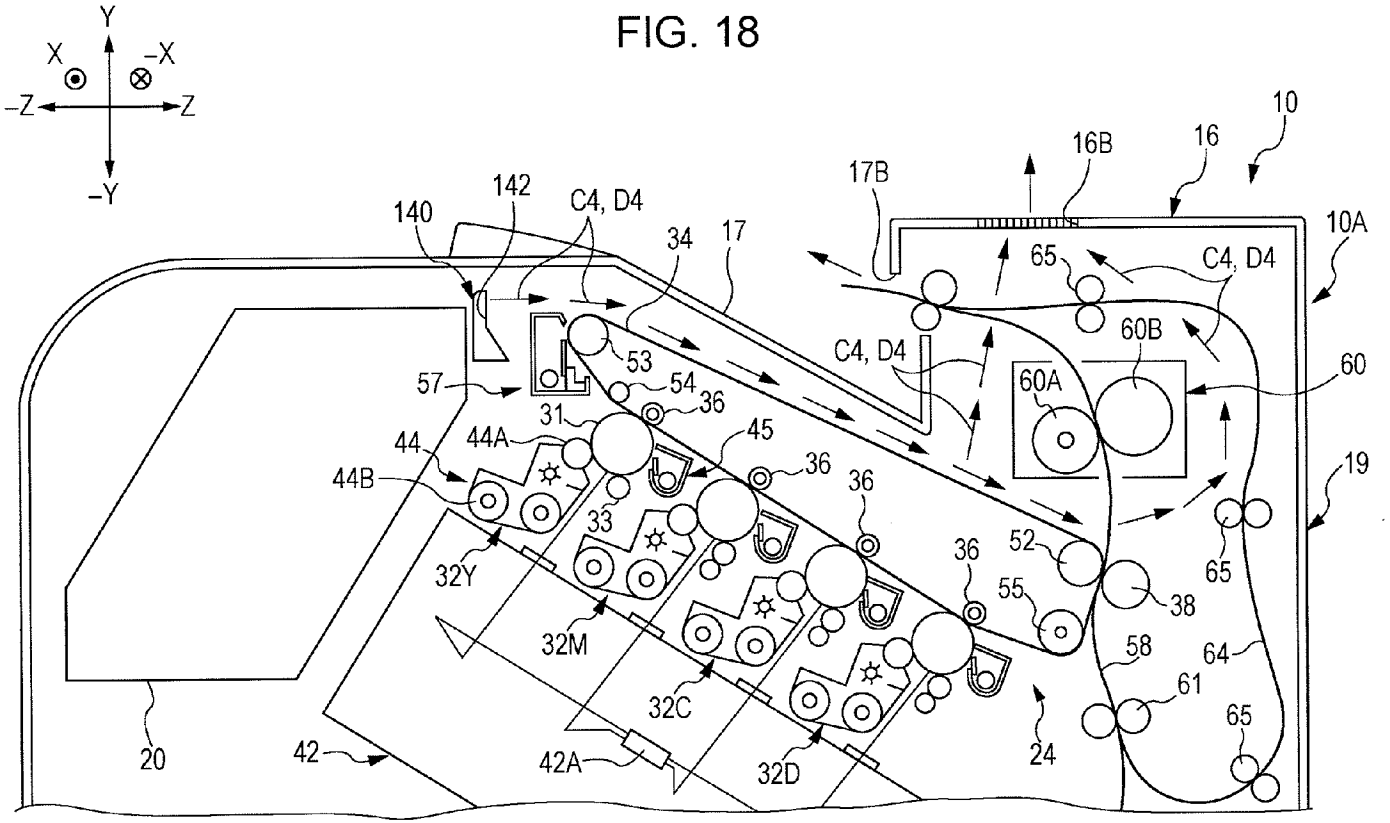
FIG. 18 schematically illustrates how air flows around an intermediate transfer belt and a fixing unit in the exemplary embodiment of the present invention.
Figure 19:
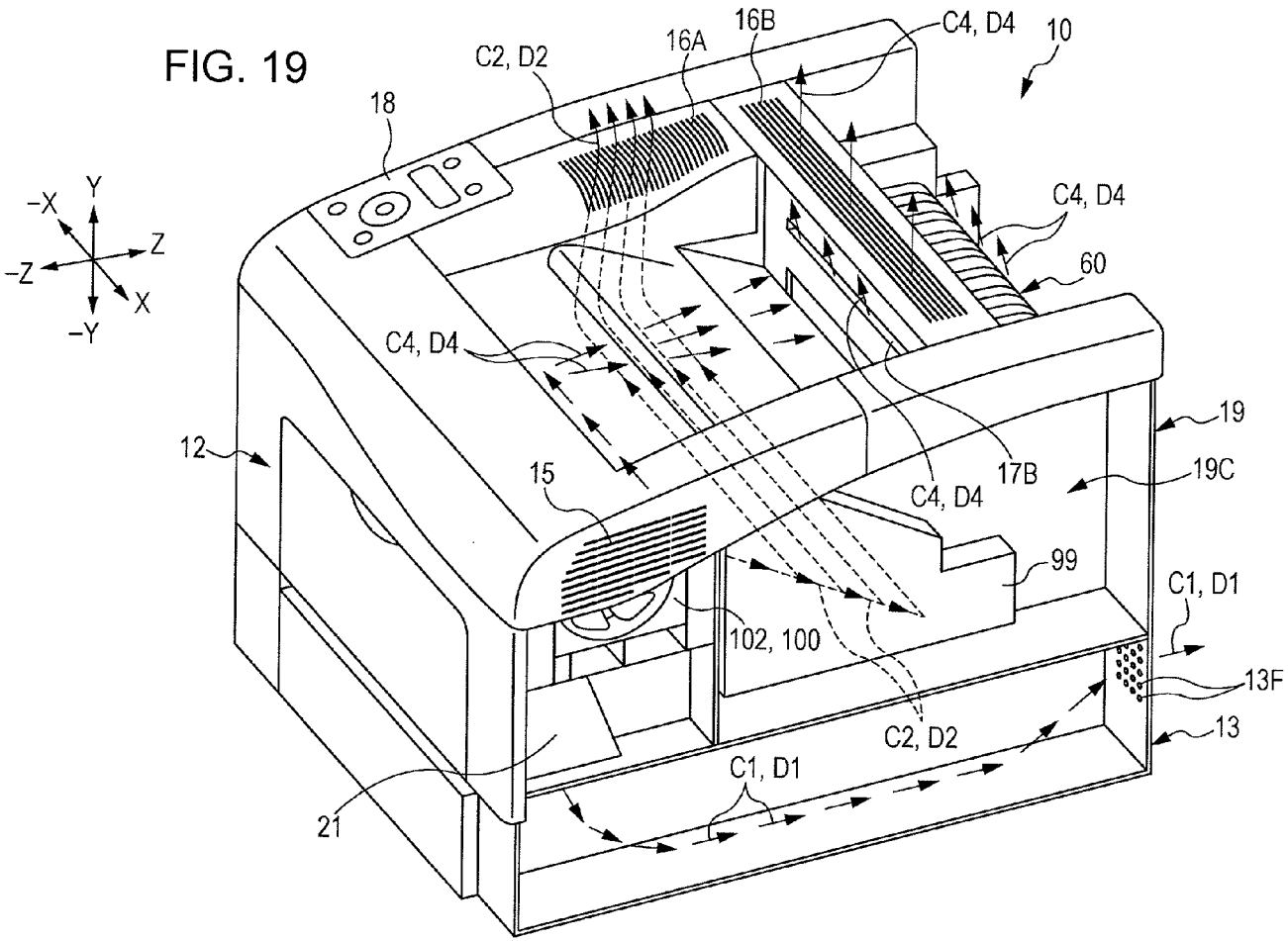
FIG. 19 illustrates how air flows in the image forming apparatus in the exemplary embodiment of the present invention.

Referring to FIG. 18, the airflows C4 and D4 flowed from the rectifying member 110 and the duct covering member 120 (see FIG. 17) into the intermediate-transfer-side duct 140 flow out of the air sending port 142 and go between the intermediate transfer belt 34 and the output portion 17 toward the Z-direction side. Subsequently, the airflows C4 and D4 are each separated into airflows flowing on the −Z-direction side and on the Z-direction side, respectively, of the fixing device 60, which has a high temperature. Referring now to FIGS. 18 and 19, the airflows C4 and D4 flowed on the −Z-direction side of the fixing device 60 are heated by the heat from the fixing device 60, go upward in the Y direction by the chimney effect produced by the heat from the fixing device 60, and are exhausted from the rear air outlet 16B or the output slit 17B. Meanwhile, the airflows C4 and D4 flowed on the −Y-direction side of the fixing device 60 and then to the Z-direction side of the fixing device 60 are heated by the heat from the fixing device 60, go upward in the Y direction by the chimney effect produced by the heat from the fixing device 60, and are exhausted from the rear air outlet 16B.

Thus, in the image forming apparatus 10, although there are restrictions on the position of the fan 102 (the duct covering member 120 (see FIG. 15) is provided near the fan 102), the swirl flow is guided by the rectifying member 110. Therefore, the pressure loss in sending air is reduced, and the image forming section 24, the fixing device 60, and the power source section 70 (see FIG. 17) are cooled.

The present invention is not limited to the above exemplary embodiment.

The bends 112A, 112B, 113A, 113B, 113C, 114A, and 114B (see FIG. 9) may be replaced with curves provided by curving the rectifying plates 112, 113, and 114 (by forming curved surfaces on the rectifying plates 112, 113, and 114). Moreover, the number of bends is not necessarily one or two and may be more, or may be zero if the rectifying plates 112, 113, and 114 have curved surfaces.

The air sending mechanism 100 may be configured to send air to one or two of the image forming section 24, the fixing device 60, and the power source section 70.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An air sending mechanism comprising:

an air sending unit including a rotating shaft and a plurality of blade members provided on the rotating shaft, the air sending unit being configured to send air by producing a swirl flow swirling about the rotating shaft with rotation of the plurality of blade members;

a wall member provided on a downstream side in an air sending direction with respect to the air sending unit in such a manner as to face the air sending unit; and a rectifying member provided between the air sending unit and the wall member and having at least one bend or curve provided as a result of the member being angled or curved such that the swirl flow produced by the air sending unit is guided in an intersecting direction that intersects the air sending direction, wherein the rectifying member is angled or curved in an opposite direction that is opposite to a guiding direction in which the swirl flow is guided, the rectifying member guiding the swirl flow toward an air outlet provided on a downstream side in the opposite direction.

2. An air sending mechanism comprising:

an air sending unit including a rotating shaft and a plurality of blade members provided on the rotating shaft, the air sending unit being configured to send air by producing a swirl flow swirling about the rotating shaft with rotation of the plurality of blade members;

a wall member provided on a downstream side in an air sending direction with respect to the air sending unit in such a manner as to face the air sending unit; and a rectifying member provided between the air sending unit and the wall member and having at least one bend or curve provided as a result of the member being angled or curved such that the swirl flow produced by the air sending unit is guided in an intersecting direction that intersects the air sending direction, wherein the rectifying member has a plurality of spaces separated by at least one rectifying plate, and wherein at least one pair of the plurality of spaces that are adjacent to each other communicate with each other via a hole provided in the rectifying plate.

* * * * *